US011618147B2

(12) United States Patent
Fravor

(10) Patent No.: US 11,618,147 B2
(45) Date of Patent: Apr. 4, 2023

(54) COMBAT VEHICLE RESCUE TOOL

(71) Applicant: John P. Fravor, Pulaski, NY (US)

(72) Inventor: John P. Fravor, Pulaski, NY (US)

( * ) Notice: Subject to any disclaimer, the term of this patent is extended or adjusted under 35 U.S.C. 154(b) by 382 days.

(21) Appl. No.: 16/871,233

(22) Filed: May 11, 2020

(65) Prior Publication Data

US 2020/0269408 A1 Aug. 27, 2020

Related U.S. Application Data

(63) Continuation-in-part of application No. 15/411,541, filed on Jan. 20, 2017, now abandoned.

(51) Int. Cl.

| | |
|---|---|
| ***B25F 1/00*** | (2006.01) |
| ***B25B 13/04*** | (2006.01) |
| ***E05B 19/00*** | (2006.01) |
| ***B26B 3/00*** | (2006.01) |
| ***B25B 13/48*** | (2006.01) |

(52) U.S. Cl.

CPC ..... *B25F 1/00* (2013.01); *B25B 13/04* (2013.01); *B25B 13/48* (2013.01); *B26B 3/00* (2013.01); *E05B 19/0017* (2013.01)

(58) Field of Classification Search

CPC ..... B25B 23/00; B25B 23/0028; B25B 13/00; B25B 13/04; B25B 13/06; B25B 13/48; B25F 1/00; B26B 3/00; E05B 19/0017; A26B 3/00

See application file for complete search history.

(56) References Cited

U.S. PATENT DOCUMENTS

| | | | | |
|---|---|---|---|---|
| 1,146,544 | A * | 7/1915 | Anderson | B25B 23/12 81/125 |
| 5,970,552 | A * | 10/1999 | Kwiecien | B25F 1/006 7/138 |
| 6,688,196 | B2 * | 2/2004 | Warner | B25B 15/008 81/177.6 |
| 7,472,631 | B1 * | 1/2009 | Wu | B25G 1/063 81/177.8 |
| 2011/0113932 | A1 * | 5/2011 | Lambert | B25B 13/46 81/125 |
| 2016/0176028 | A1 * | 6/2016 | Doggett | B25B 23/0035 81/177.1 |

* cited by examiner

*Primary Examiner* — Robert J Scruggs
(74) *Attorney, Agent, or Firm* — Harris Beach PLLC

(57) ABSTRACT

A combat vehicle rescue tool for operating a combat lock to open a door of a combat vehicle by engaging an exterior mechanical rescue coupler includes a handle having a first end extending in to a first forked arm and a second forked arm. A selectable angle end wrench includes a box wrench which is sized to fit an exterior mechanical rescue coupler of a combat vehicle door. A rectangular stem of the end wrench has at least three angled faces on a rectangular stem end opposite to the box wrench. A detent mechanism engages each of the at least three angle faces and the pair of face surfaces to set a predetermined angle of the selectable angle end wrench with respect to a long axis of the handle. A spare fastener pin can be threadingly stored in the end face of the tapered end of the tool.

20 Claims, 26 Drawing Sheets

COMBAT VEHICLE RESCUE TOOL

CROSS-REFERENCE TO RELATED APPLICATIONS

This application claims priority to and the benefit of co-pending U.S. patent application Ser. No. 15/411,541, COMBAT VEHICLE RESCUE TOOL, filed Jan. 20, 2017 which application is incorporated herein by reference in its entirety.

FIELD OF THE APPLICATION

The application relates to a combat vehicle rescue tool and particularly to a combat rescue tool which couples to and turns a mechanical connection point of a combat lock.

BACKGROUND

Mine-resistant ambush protected (MRAP) vehicles are used commonly in conflict areas, especially where improvised explosive devices (IED) are a daily threat. The MRAP vehicle doors use combat locks. Combat locks typically provide rescue access by rotation of a mechanical coupler accessible via a recessed part of an outer panel of the vehicle. The mechanical coupler typically includes a male square rotatable connection point.

SUMMARY

A combat vehicle rescue tool for operating a combat lock to open a door of a combat vehicle by engaging an exterior mechanical rescue coupler includes a handle of a combat vehicle rescue tool. The handle has about a rectangular cross section defined by two wide surfaces and two smaller side surfaces. The handle includes a first end extending into a first forked arm and a second forked arm, an inside fork surface of both forked arms defining a substantially rectangular opening, both forked arms including a cylindrical wall defining through-holes perpendicular to a long axis of the handle and sized to accept a fastener pin, and a second tapered end of the handle having tapered side surfaces, each corner of the tapered end rounded over, the second tapered end configured for passing through a plurality of combat vest MOLLE loops for stowage on and removal from the combat vest, and the end face of the second tapered end including a cylindrical wall threaded in part to accept a spare fastener pin threadingly engaged within. A selectable angle end wrench of a combat vehicle rescue tool is pivotally mounted to the handle by the fastener pin. The selectable angle end wrench includes a box wrench sized to fit an exterior mechanical rescue coupler of a combat vehicle door. The selectable angle end wrench has a pair of face surfaces. The selectable angle end wrench extends into a rectangular stem having a stem width sized to rotatingly fit into the substantially rectangular opening. The rectangular stem has an end wrench cylindrical wall parallel to a face plane of the pair of face surfaces. The end wrench cylindrical wall is defined by a hole through the rectangular stem sized to accept the fastener pin. The rectangular stem has at least three angled faces on a rectangular stem end opposite to the box wrench.

The selectable angle end wrench can include a detent mechanism including a spring biased ball or a spring biased rod with a rounded tip or a pointed tip which engages in a slot in at least one of the at least three angled faces or the pair of face surfaces to selectively engage one of the at least three angled faces and the pair of face surfaces to set a predetermined angle of the selectable angle end wrench with respect to a long axis of the handle.

The selectable angle end wrench can include an eight-point box wrench. The eight-point box wrench can accept a square mechanical coupler at a plurality of acceptance angles. The eight-point box wrench can further include bevels to guide four of eight points of the eight-point box wrench over a 4-sided square combat lock rescue mechanical coupler rotatable connection point.

The 4-sided square combat lock rescue mechanical coupler can further include an O ring disposed in a circumferential slot on a portion of the 4-sided square combat lock rescue mechanical coupler which is removably disposed in the eight-point box wrench to provide a friction hold of the portion of the 4-sided square combat lock rescue mechanical coupler disposed in the eight-point box wrench. The 4-sided square combat lock rescue mechanical coupler further can include an O ring disposed in a circumferential slot on a portion of the 4-sided square combat lock rescue mechanical coupler which is removably disposed in the selectable angle end wrench to provide a friction hold of the portion of the 4-sided square combat lock rescue mechanical coupler disposed in the selectable angle end wrench. The 4-sided square combat lock rescue mechanical coupler can further include a circular end cap.

The fastener pin can include a threaded end and a cylindrical wall of at least one of the first forked arm or the second forked arm includes a threaded cylindrical wall which defines a threaded hole. The fastener pin can include a machine screw having a head, a smooth cylindrical rod section ending in a threaded rod sized to thread into the threaded hole. The fastener pin can include a knurled head for manual operation by fingers. The fastener pin can include a hardened steel metal.

The selectable angle end wrench can be interchangeable with any one of a plurality of different sized or types of end wrenches.

The combat vehicle rescue tool can further include a seat belt cutter disposed about at an end of the handle opposite the selectable angle end wrench. The seat belt cutter can include a blade having at least a single knife blade edge. The seat belt cutter can include a blade having a pair of angled knife blade edges joined at a common apex. The blade can have a pair of angled knife blade edges is bolted onto a recess edge within the handle.

The handle can include an aluminum metal and the selectable angle end wrench includes a steel metal.

The handle can further include a shackle key.

The combat vehicle rescue tool can include a selectable angle end wrench section with detent mechanism mechanically coupled to a tubular section or a rod section, wherein the selectable angle end wrench section is sized to fit over the tubular section or the rod section, or the selectable angle end wrench section is sized to fit within the tubular section or the rod section.

A shackle pin removal tool can mount to the handle in place of the box wrench. Or, a shackle pin removal tool can slidingly mount into the box wrench.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

As described hereinabove, mine-resistant ambush protected (MRAP) vehicles are used commonly in conflict areas, especially where improvised explosive devices (IED) are a daily threat. The MRAP vehicle doors use combat locks. Combat locks typically provide rescue access by rotation of a mechanical coupler accessible via a recessed part of an outer panel of the vehicle. The mechanical coupler typically includes a male square rotatable connection point.

In any incident, which requires extraction of injured troops from a MRAP, rescue crews need a quick and reliable way to open one or more of the MRAP doors. One problem with access to the rescue mechanical coupler is that MRAPs also typically have a variety of types of screening fences mounted around the vehicle outer surfaces. The purpose of the screening fences is to minimize incoming projectile damage to the MRAP surfaces and windows, such as by causing rocket propelled grenades (RPG) to explode prior to contact with the actual MRAP skin surfaces. While, there are openings in the screening fences or similar overlay surfaces to gain access to the rescue mechanical coupler, access angles may be limited by the screening superstructure or by bent or damaged superstructure following an accident or combat caused damage.

There is a need for a relatively simple robust combat lock mechanical coupler rescue tool. The rescue tool should have flexible configurations so as to be quickly configurable for a wide variety of nearby interfering structure, while still allowing quick and reliable access to the rescue mechanical coupler of the combat door lock. The tool should also allow for coupling to a wide variety or types of rescue mechanical couplers, such as, for example, male square rotatable connection points of various sizes. The tool should also include an integral seat belt cutter so that the same tool can be used throughout a MRAP rescue evolution.

It was realized that a solution to the problem of nearby interfering superstructure is a rotatable (selectable angle) end wrench with detent positions. It was found that a detent mechanism or a friction mechanism, such as, for example, a ball and spring locking into about a right-angle position, about a 45-degree position on either of two sides, and an inline position with the rescue tool handle provides enough configuration flexibility to reliably engage a rescue mechanical coupler despite the presence of an outer projectile screening superstructure over the outer skin of the vehicle. Also, because of a crash or other combat related damage to the vehicle and its superstructure, there may be obstructed access to the rescue mechanical coupler, such as where a part of the superstructure or other parts of the vehicle or debris may have bent or been pushed over the normal access path to the rescue mechanical coupler.

Figure 1:
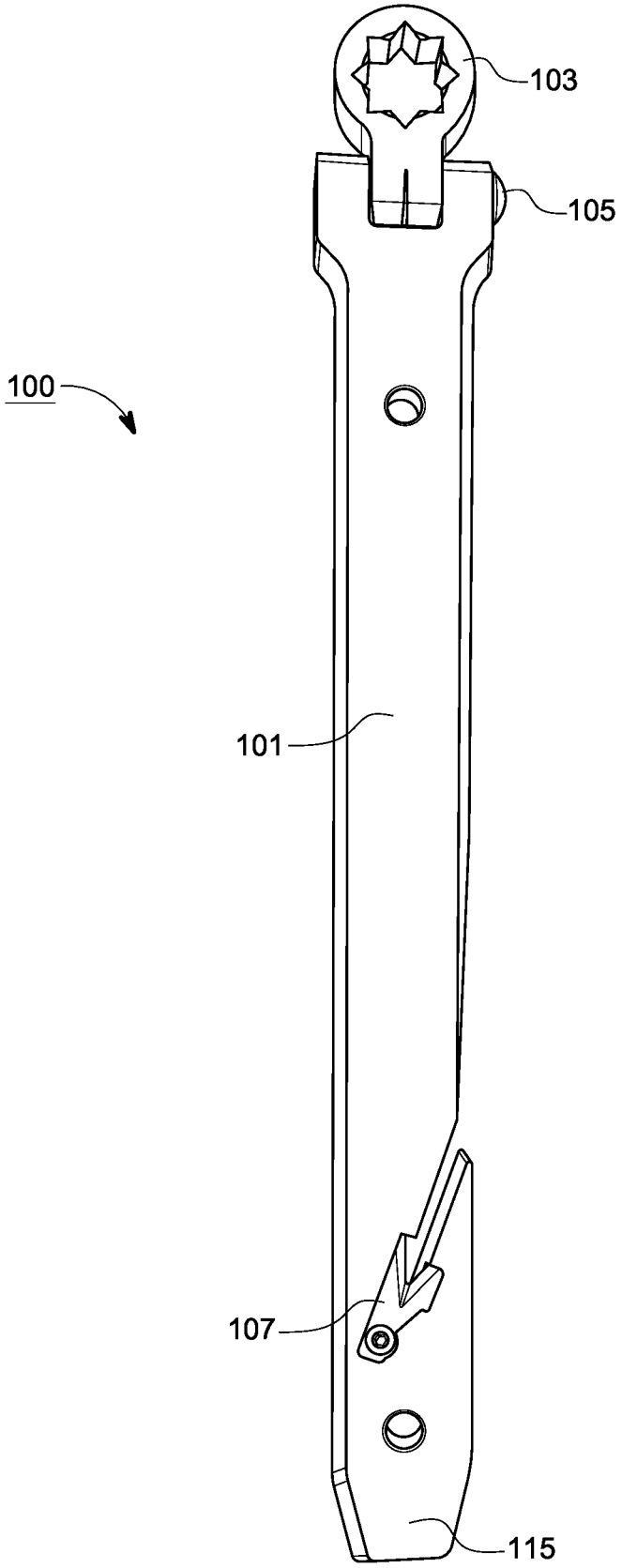
FIG. 1 shows a drawing illustrating an exemplary combat lock rescue tool according to the Application.

FIG. 1 shows one exemplary embodiment of an improved combat vehicle rescue tool used to turn a rescue mechanical coupler of a combat lock to open a door of the combat vehicle, such as a MRAP vehicle, during a rescue operation. Handle 101 includes a selectable angle end wrench 103 which pivots about fastener pin 105 to a preset angular position in forked arms 111 and 113. Any suitable fastener pin can be used. Typically, a fastener pin 105 includes a threaded end of a smooth pin shaft opposite a screw head. The screw head can be any suitable machine screw or bolt head, such as, for example flat head or oval (typically with a corresponding counter sink in handle 101), fillister, round, truss, pan, or hex. Any suitable installation driver opening can be present, such as, for example, flat head, Philips head, Torx, Spline, Allen, etc.

Handle 101 can include an integral seatbelt cutter 107 at a second end of the combat vehicle rescue tool. There can also be a tapered or pointed section 115 to assist in entering and prying panels or other parts during a rescue operation. However, it is important that the tapered end have rounded edges without sharp points so that the tool not damage the combat MOLLE loops through which it is typically stored and carried. The new combat vehicle rescue tool of the Application stows in a flat longitudinal line through a plurality of MOLLE loops. Any significant bends or protrusions, or a rectangular end with sharp edges could make a tool unsuitable for combat carry. Indeed, merely falling the wrong way on a tool end with sharp features could severely wound or kill a soldier attempting to carry such a tool.

Figure 2A:
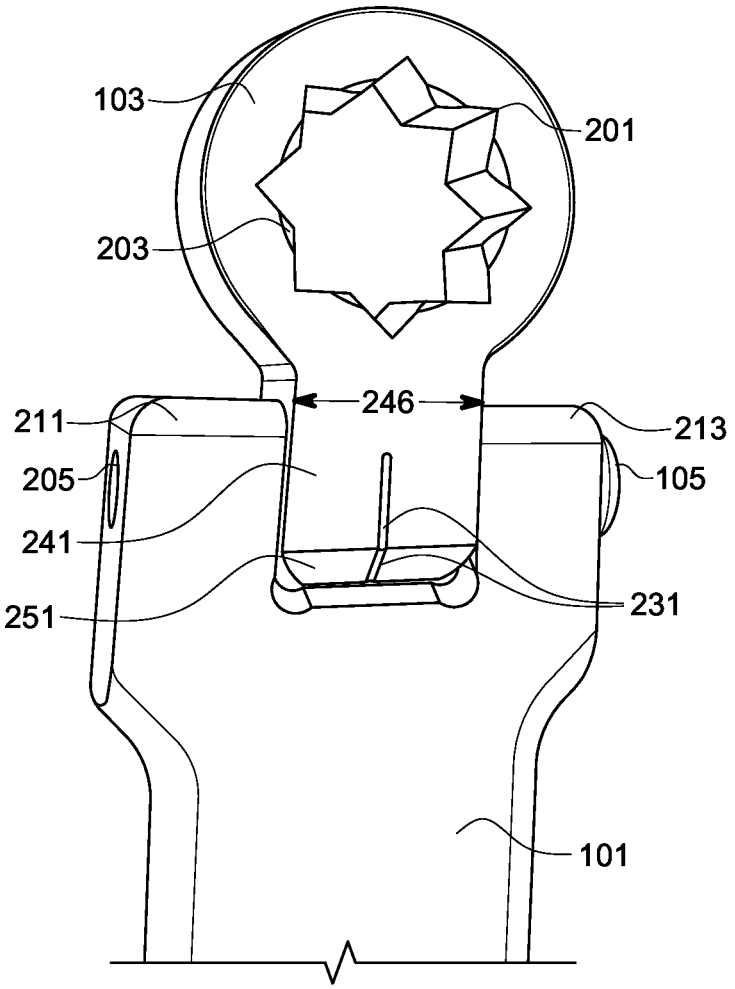
FIG. 2A shows a detailed drawing of the swivel detent angle wrench end of the tool of FIG. 1.

FIG. 2A shows the wrench end in more detail. In some embodiments, the end wrench 103 includes a pointed box wrench. The exemplary wrench of FIG. 1, FIG. 2 includes, for example, an eight-point box wrench. The eight-point box wrench further includes bevels 203 to more quickly and reliably guide four of the eight points over a typical 4-sided square combat lock rescue mechanical coupler rotatable connection point. A first degree of freedom in positioning such a rescue tool is that the eight-point box wrench tool can engage the 4-sided square mechanical connection part at a plurality of acceptance angles, including every 45-degrees of end wrench rotation in about a surface plane of the face of the end wrench. The end wrench further includes a rectangular stem 241.

Figure 2B:
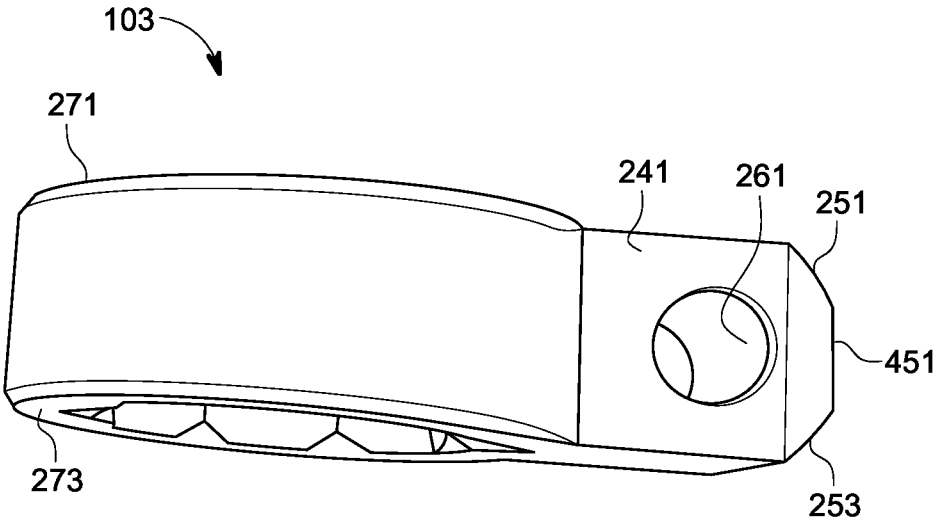
FIG. 2B shows a drawing of the interchangeable end wrench of FIG. 2A.

FIG. 2B shows cylindrical opening 261 in rectangular stem 241 provides a through swivel hole through which fastener pin 105 passes. The face of end wrench 103 can be rotated between preset positions from about a right angle to a long axis of handle 101 to about in-line with the long axis of handle 101. The preset angles can be set by providing flats on the end of rectangular stem 241. For example, in FIG. 2A, 45-degree flat 251 provides a stable 45-degree angle of wrench end 103, 45-degree flat 253 provides a stable 45-degree angle of wrench end 103, and flat 451 provides a 0-degree or inline position of the end wrench 103.

An interchangeable end wrench is sized to fit a mechanical connection part larger than a mechanical connection part which corresponds to end wrench 103 of FIG. 2A. The interchangeable end wrench is sized to fit a mechanical connection part smaller than a mechanical connection part which corresponds to end wrench 103 of FIG. 2A.

Figure 3:
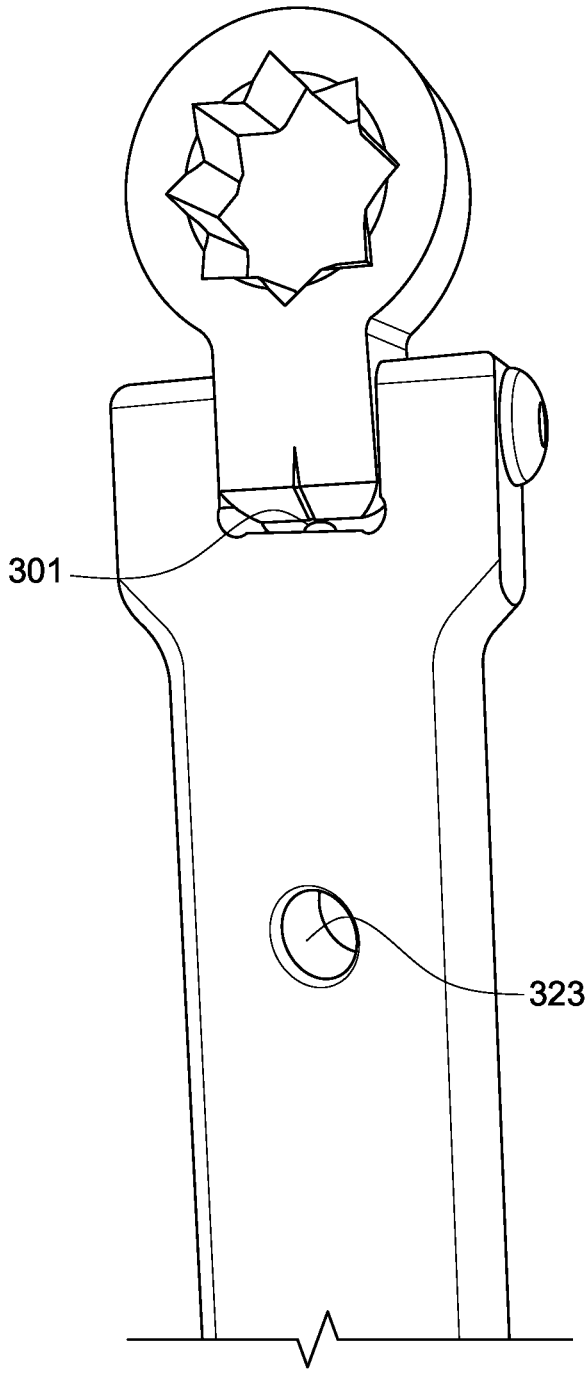
FIG. 3 shows a drawing of the spring ball detent mechanism of the tool of FIG. 1.

FIG. 3 shows one exemplary detent mechanism as a spring biased ball 301, or spring biased post with a ball end, acting against a channel, such as channel 231 that provides a locking ability to stabilize end wrench 103 at a desired angle (as a selectable angle end wrench) using one of the available flats, such as flat 251 in a 45-degree end wrench angled position. There can be any suitable trough, indentation, cup indentation, line indentation, etc. to accept the tip of spring biased ball 301 to secure end wrench 103 into one of the available pre-determined angled positions. In the exemplary embodiment of FIG. 1, the angled positions available are −90 degrees, −45 degrees, 0 degrees (in line with handle 101), 45 degrees, and 90 degrees. These pre-determined end wrench angles correspond to the flat faces of the end wrench extending to the rectangular stem (−90 degrees, 90 degrees), the two 45 degree angled surfaces at the distal end of the rectangular stem opposite to the eight-point box wrench (−45 degrees, 45 degrees), and the most distal flat perpendicular to the eight-point box wrench face surfaces (0 degrees).

An additional cylindrical wall 323 can define a hole in the handle 101 for any suitable carrying lanyard or to post or stow the tool when not in use.

Figure 4A:
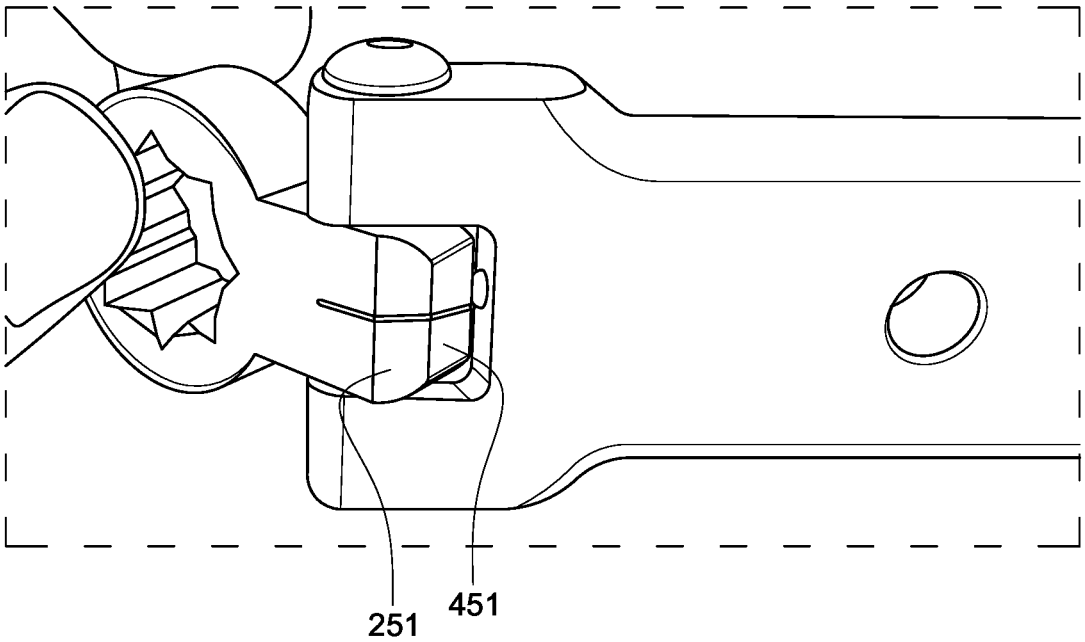
FIG. 4A shows a drawing of the swivel detent angle wrench end of the tool of FIG. 1.
Figure 4B:
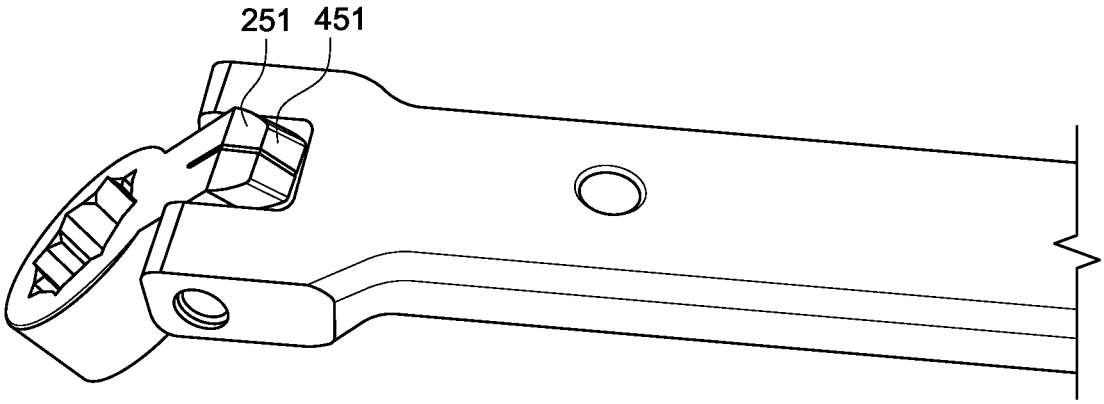
FIG. 4B shows another view of the swivel detent angle wrench end of FIG. 4A.
Figure 4C:
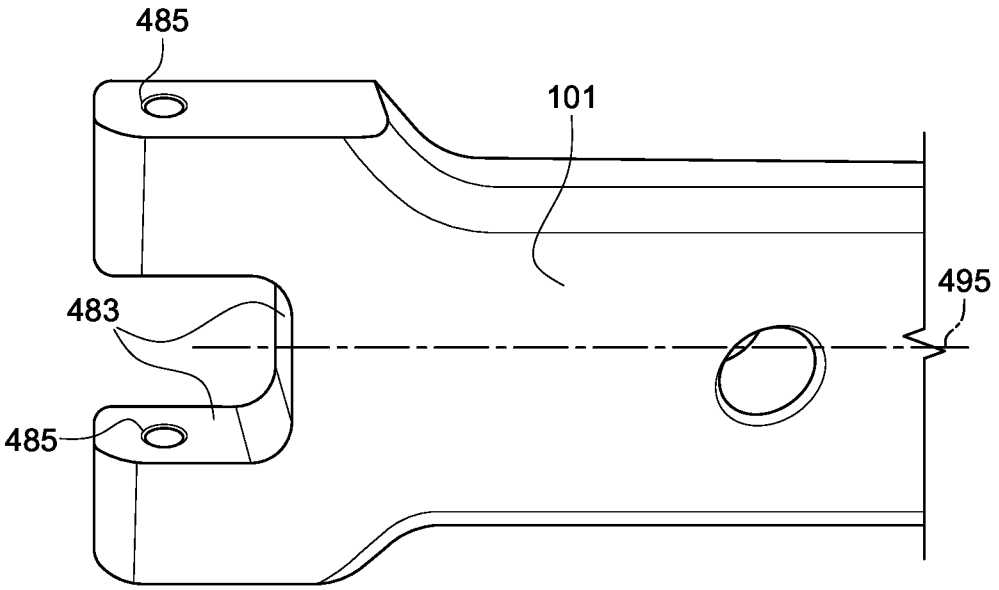
FIG. 4C is a drawing showing the rectangular opening defined by the forked arm ends.
Figure 4D:
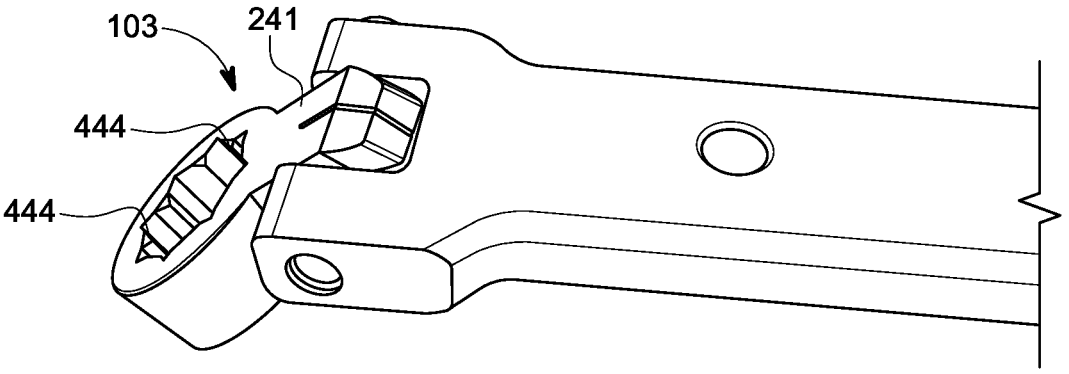
FIG. 4D is a drawing that shows an exemplary box wrench of the wrench end.

FIG. 4A shows end wrench 103 where spring biased ball 301 is holding end wrench 103 at about a 45-degree angle with respect to handle 101 by acting against a 45-degree flat 251. With the end wrench 103 so positioned, end flat 451 is visible in FIG. 4A. End flat 451 is engaged by spring biased ball 301 when the end wrench 301 is in the inline position substantially in-line with handle 103 as shown in FIG. 1. FIG. 4B shows another view of end wrench 103 in a 45-degree position. FIG. 4C is a drawing showing the rectangular opening defined by the forked arms, also referred to as the forked ends or shoulder arms of handle 101. FIG. 4D is a drawing that shows an exemplary box wrench of the wrench end.

Figure 4E:
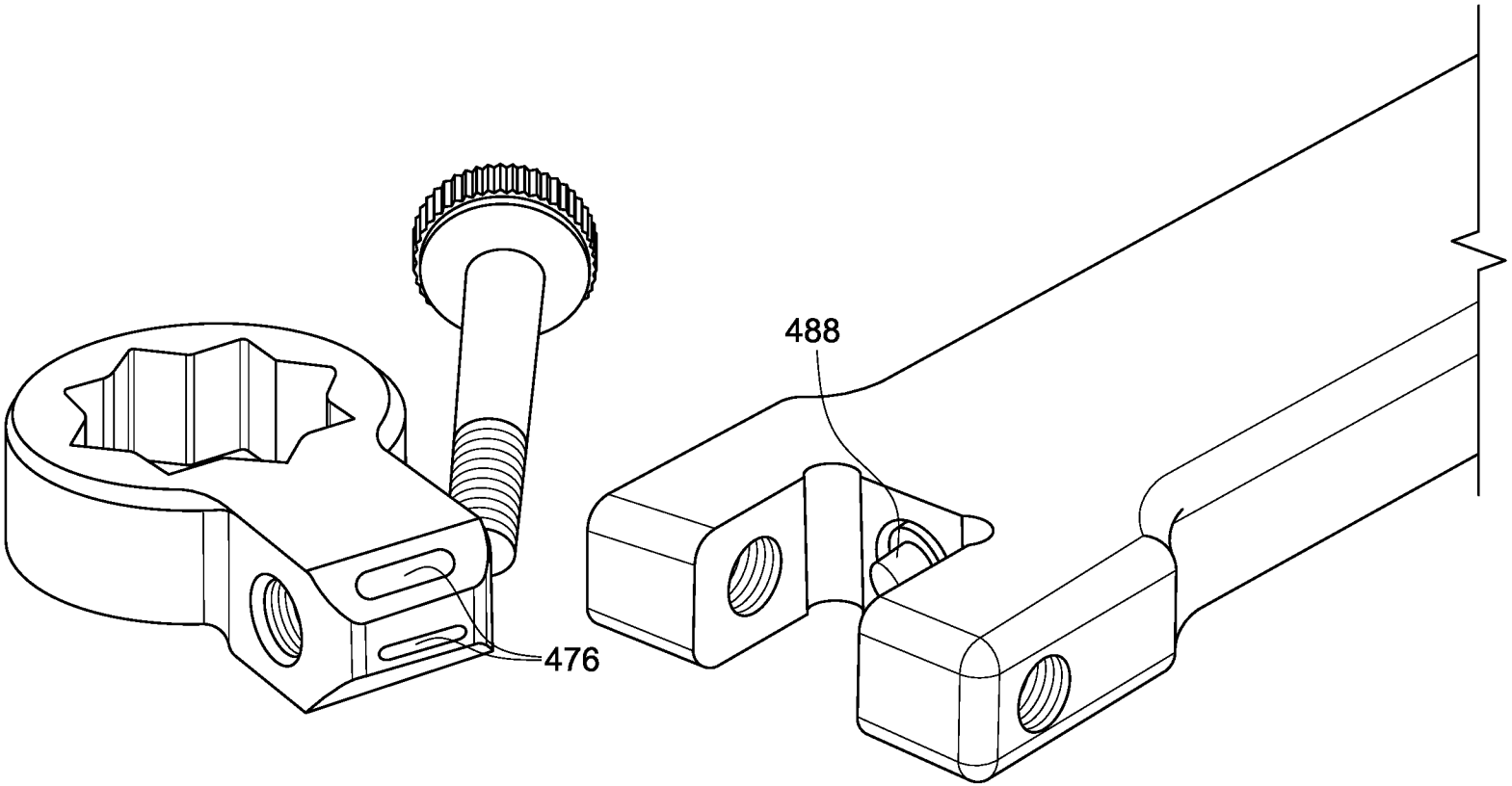
FIG. 4E is a drawing that shows another exemplary detent angle wrench end disassembled.

FIG. 4E is a drawing that shows another exemplary detent angle wrench end disassembled. Spring biased rod 488 with round tip engages oval pockets 476 in each of the angled flats. The oval pockets 476 provide more efficient locking at the desired angle. The exemplary detent angle wrench end of FIG. 4E is assembled in the flat position. The exemplary detent angle wrench end of FIG. 4E can be assembled in the flat position.

The end wrench can be made from any suitable material, typically a metal material. An end wrench typically can be made from a steel, stainless steel, titanium, or combinations thereof. Metal alloys, such as for example, steel alloys are suitable end wrench materials. Typically, an end wrench is manufactured by machining, however, any suitable manufacturing technique can be used, such as, for example, stamping, laser cutting, water jet cutting, etc.

Figure 5:
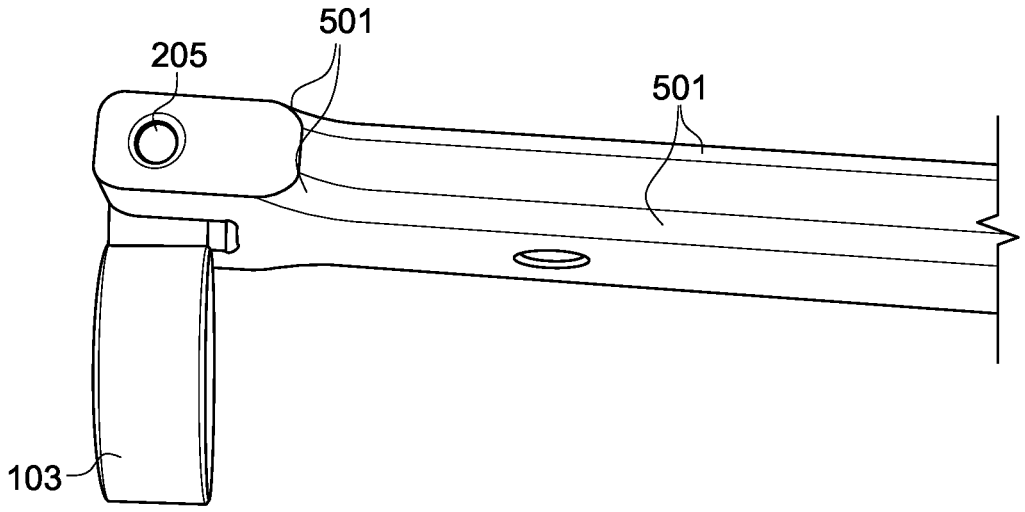
FIG. 5 shows a drawing illustrating the swivel detent angle wrench end at about a 90-degree angle to the tool handle.

FIG. 5 shows a side view of the combat vehicle rescue tool where end wrench 103 is at a 90-degree position about perpendicular to the long axis of handle 101. In the embodiment of FIG. 5, a threaded end of fastener pin 105 engages threaded cylindrical wall 205 of fork 111 of handle 101 which define a threaded hole.

Figure 6:
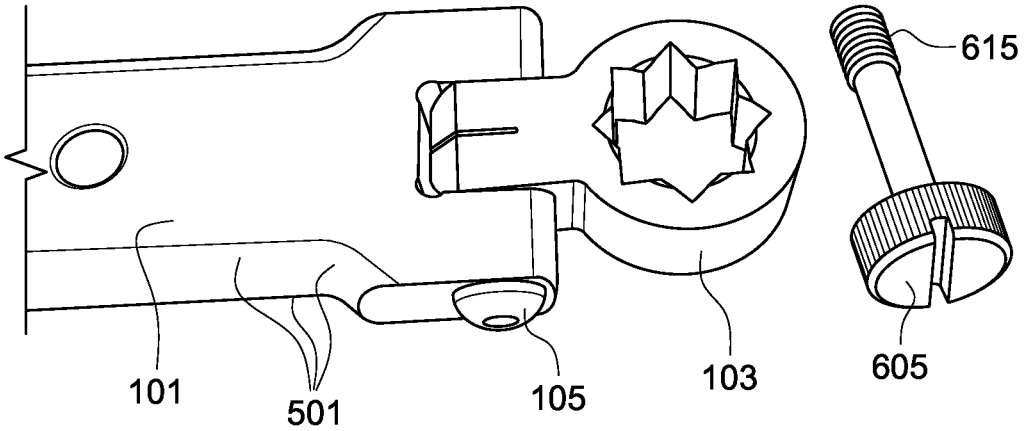
FIG. 6 shows an alternative fastener for coupling the swivel detent angle wrench end to the tool handle.

FIG. 6 shows another style of a knurled head fastener post 605 having threads 615 which can engage the threaded cylindrical wall 205 of fork 111 of handle 101. A knurled head fastener post 605 can be accessed quickly by hand or manual operation to change an interchangeable end wrench 103.

Typically, the corners of handle 101 can be rounded over as shown by corners 501 in FIG. 5, and FIG. 6 to allow for a more robust hand grip by the rescue operator. Also, the rounded edges allow for the combat vehicle rescue tool to be more easily inserted or removed from the webbing of a vest kit or body armor.

Figure 17:
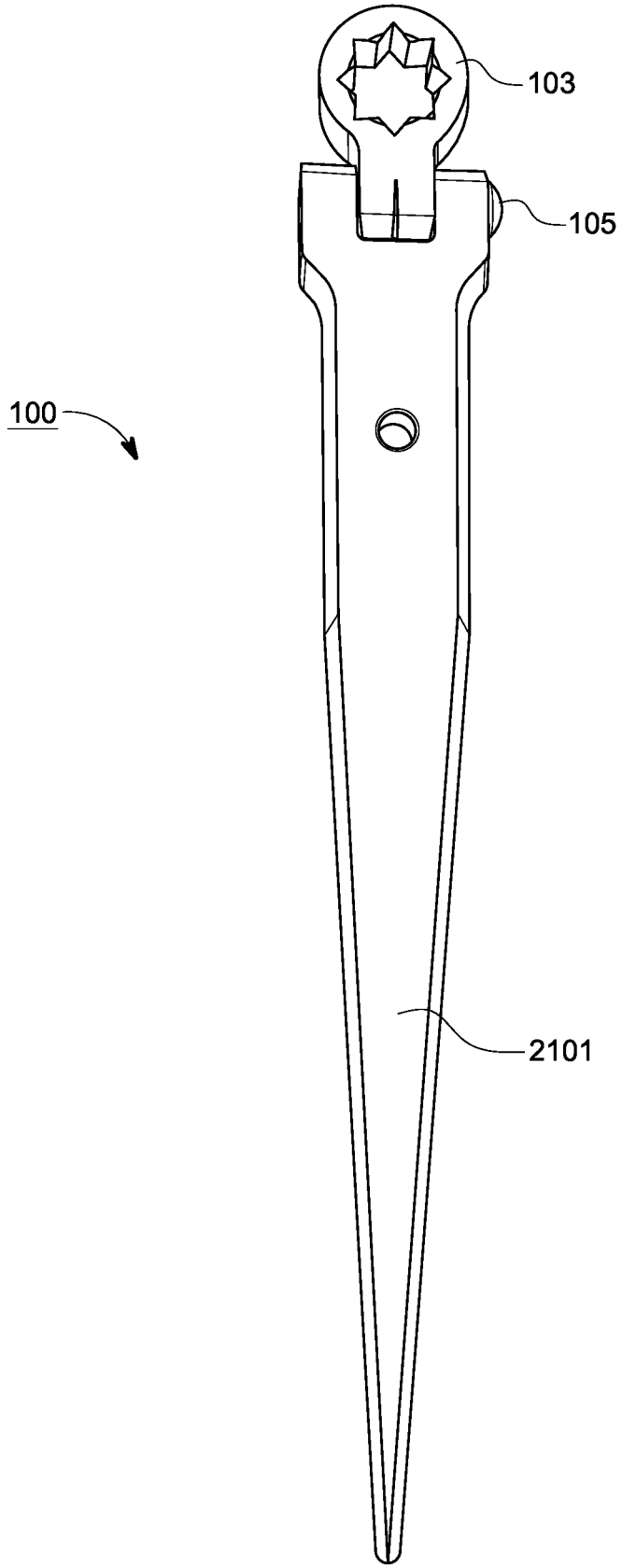
FIG. 17 shows an exemplary contemplated tool handle in the form of a shackle pin removal tool.

FIG. 17 is a drawing that shows an exemplary combat vehicle rescue tool held to a vest by a plurality of web straps 1701.

Figure 7:
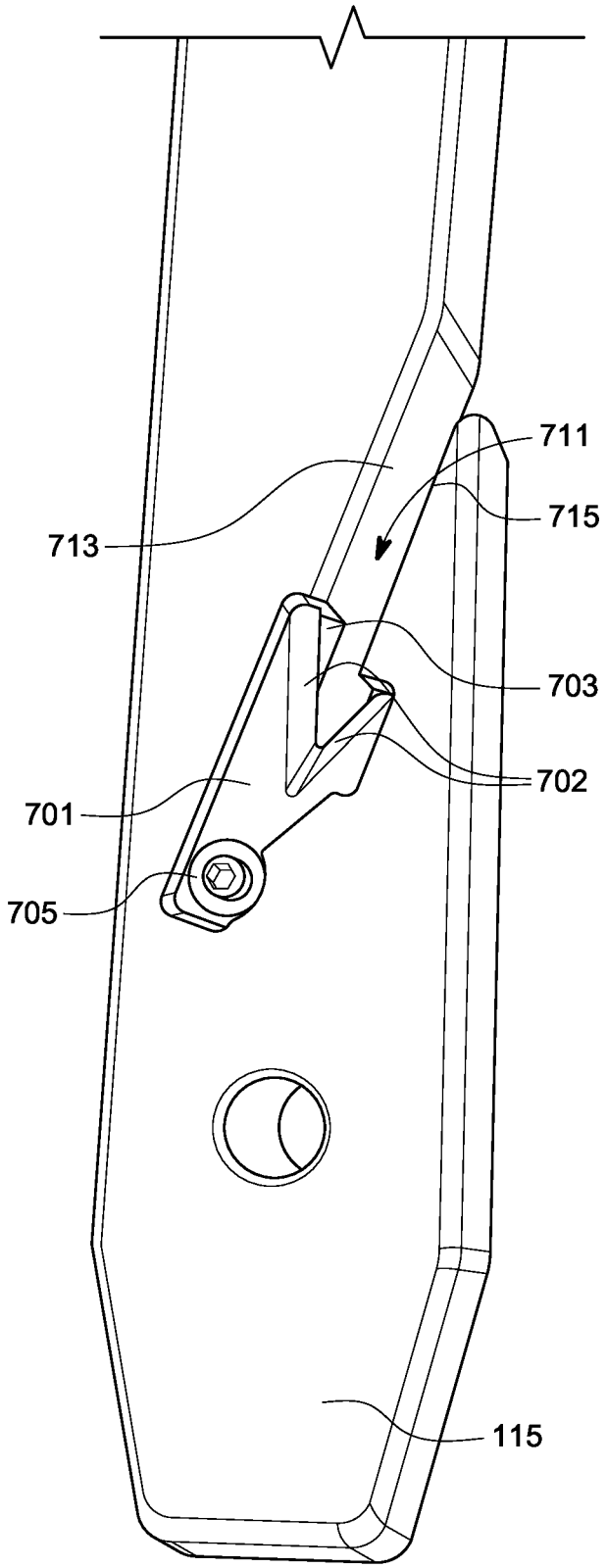
FIG. 7 shows a drawing of an exemplary seatbelt cutter of the tool of FIG. 1.

FIG. 7 shows the second end of the exemplary rescue tool of FIG. 1. A channel 711 is defined by walls 713 and 715 to provide a path for a seat belt into knife blade edges 702 of the seatbelt cutting blade 701. In embodiments similar to FIG. 7, the channel is typically at an angle of more than about 10 degrees from the long axis of the handle. In this manner, angled channel can act as a hook as the handle of the combat vehicle rescue tool is pushed under a seatbelt to capture the belt, and then to cut a seat belt when the tool is pulled back. There could also be a single blade edge. While less common, there could also be blades having more than two blade edges.

Figure 15:
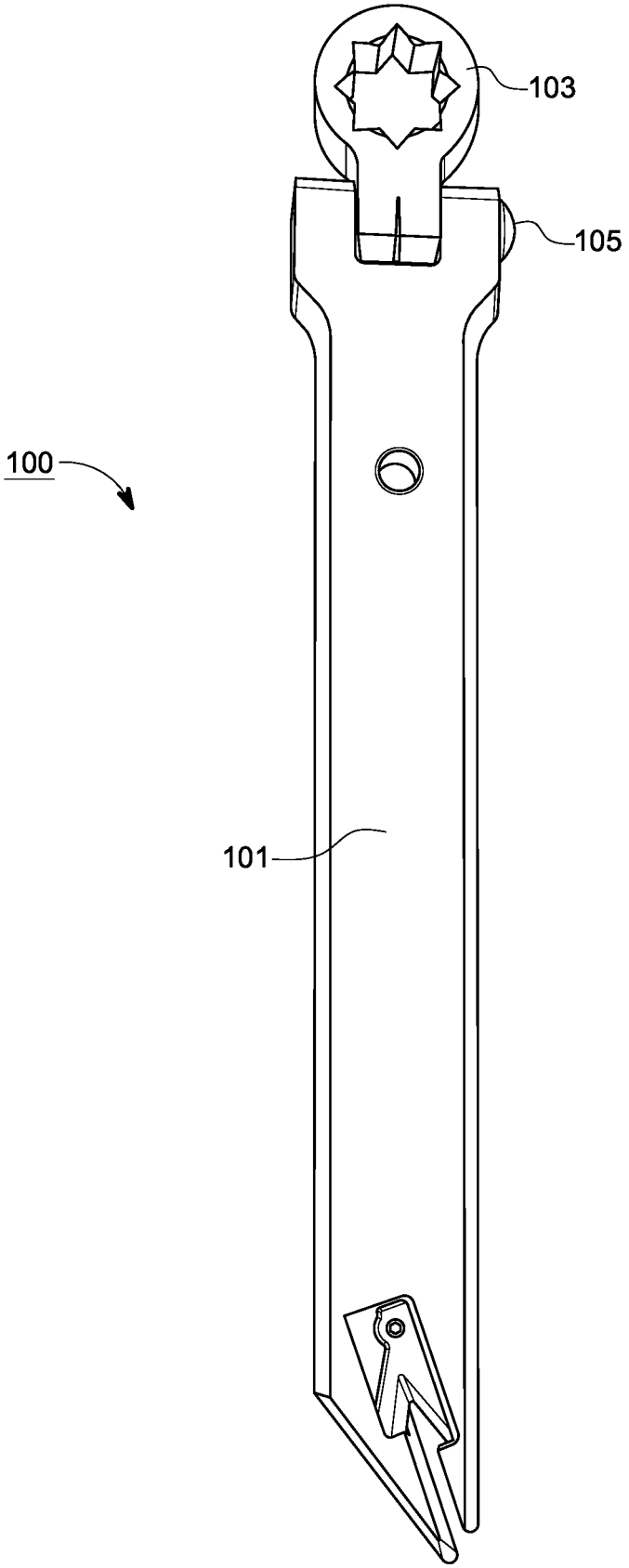
FIG. 15 shows a drawing of a combat vehicle rescue tool having a channel disposed at the end of the tool handle.

There can be other embodiments of the seatbelt cutter where the cutting action takes place as the tool is pushed onto the seatbelt. FIG. 15 shows a drawing of a contemplated exemplary embodiment of a combat vehicle rescue tool, where the channel is located at the end of the tool, or at about the end of the tool. An advantage of the seat belt cutter with the channel at the end of the handle is that there may be post incident situations where the tool cannot first be safely pushed under a belt to engage a hook action channel. It may be that the tool cannot be safely pushed under a belt because of structural damage or interfering structures or body worn gear or materials such as body armor. Or, it may be that the tool cannot be safely pushed under a belt because of the nature of nearby body wounds. While FIG. 15 shows one exemplary end channel embodiment, it is understood that an end channel could be at any suitable angle, typically from about in line with the longitudinal axis of the handle to about +/−45 degrees of the longitudinal axis of the tool. Also, an end channel could open on a side of the combat vehicle rescue tool near the end of the tool, or at any other suitable position from one side of the end of the tool to another (e.g. at any suitable location right to left along or near the end or nose of the tool).

It is contemplated that there could also be embodiments of the combat vehicle rescue tool having either or both embodiments of the seat belt cutter as a hook channel or push channel.

Seatbelt cutting blade 701 can be bolted into a recess 703 of handle 101 such as by bolt 705. Bolt 705 can be any suitable type of machine screw or machine bolt of any suitable thread, with any suitable head. In operation, the seat belt to be cut is slid into channel 711 and the rescue tool 100 is pulled over the seatbelt so as to cut completely through and sever the seatbelt. A cylindrical opening 735 can define a hole useful for a carrying lanyard or to accept a post for stowing the tool when not in use. A tapered or pointed section 115 can assist in entering and prying panels or other parts during a rescue operation.

While FIG. 7 shows an embodiment of a seatbelt cutter having a single blade with two blade edges that join at a vertex, there can be other embodiments of seat belt cutter blades. For example, there could be a seat belt cutter with a single blade with a single edge at the terminus of a seat belt cutter channel. An exemplary seat belt cutter can include a single blade with a single edge. In embodiments, there can be any suitable location or angle of a single blade with a single edge in or adjacent to a cutting channel. It is understood that there typically will be one or more notches, slots, or holes in such blades to secure the blade in the handle of the tool.

Figure 8:
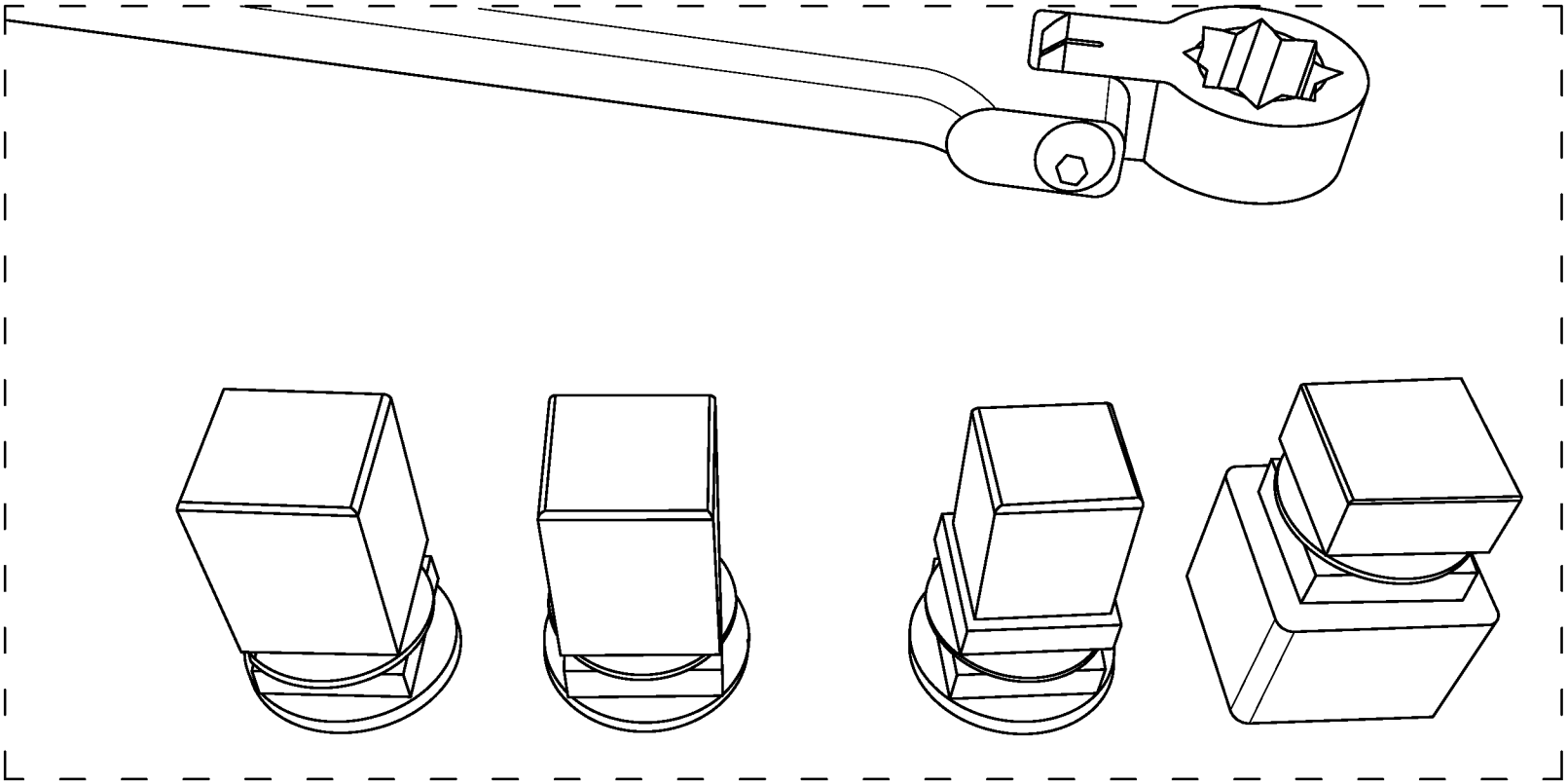
FIG. 8 shows drawings of a variety of combat lock square mechanical connection parts.

FIG. 8 shows a rescue tool according to FIG. 1 in the background and four different exemplary 4-sided square combat lock rescue mechanical coupler rotatable connection points in front. There can be different 4-sided square combat lock rescue mechanical coupler rotatable connection points. The exemplary 4-sided square combat lock rescue mechanical coupler can include an O-ring disposed in a circumferential slot on the portion of the 4-sided square combat lock rescue mechanical coupler which goes into the selectable angle end wrench, such as, for example, an eight-point box wrench. The O-ring provides a friction hold of said portion of the 4-sided square combat lock rescue mechanical coupler disposed in the selectable angle end wrench. The 4-sided square combat lock rescue mechanical coupler can also include a circular end cap.

End wrenches of different types and sizes, male and female: While presently most combat locks include a square rotatable exterior access mechanical coupler for rescue access to open the combat locked door of a combat vehicle, it is contemplated that there can be other types of mechanical couplers designed to accept or mate with an end wrench type different from the present square mechanical coupler standard. It is contemplated that interchangeable end wrenches, already designated for different sized square mechanical couplers, can also be provided to mate with other types of mechanical couplers, either male or female. For example, there could be male end wrench parts having a protruding triangle, square, hex (e.g. Allen key), star (e.g. TORX), or other suitable protruding portion (as opposed to an open female multi-point end wrench part). Those skilled in the art will understand that end wrenches for other types of mechanical rescue couplers now known or as designed in the future can be made in the spirit of end wrench 103, with a rectangular stem to fit a handle 101 as described hereinabove.

Exemplary embodiment: A combat vehicle rescue tool for operating a combat lock to open a door of a combat vehicle by engaging an exterior mechanical rescue coupler includes a handle 101, FIG. 1 having a first end extending in to a first forked arm 211 and a second forked arm 213. The inside fork surfaces 483, FIG. 4C of both forked arms defines a substantially rectangular opening, both forked arms including a cylindrical wall defining through-holes 485, FIG. 4C perpendicular to a long axis 495 of the handle 101 and sized to accept a fastener pin 105, FIG. 1. A selectable angle end wrench 103, FIG. 1, FIG. 2B includes a box wrench 444, FIG. 4D which is sized to fit an exterior mechanical rescue coupler of a combat vehicle door. The selectable angle end wrench has a pair of face surfaces 271, 273, FIG. 2B. The selectable angle end wrench extends into a rectangular stem 241 having a stem width 246 which is sized to rotatingly fit into the substantially rectangular opening. The rectangular stem has an end wrench cylindrical wall 261 parallel to a face plane of the pair of face surfaces 271, 273. The end wrench cylindrical wall 261 defines a hole through the rectangular stem 241 is sized to accept the fastener pin 105. The rectangular stem 241 has at least three angled faces 251, 241, 253 on a rectangular stem end opposite to the box wrench. A ball shaped detent mechanism 301, FIG. 3 engages each of the at least three angle faces and the pair of face surfaces to set a predetermined angle of the selectable angle end wrench with respect to a long axis of the handle 101.

In most embodiments, the combat vehicle rescue tool can be stored as a carried tool in a personal worn kit or carry kit, typically a vest worn as outer wear over personal armor. As well known to those skilled in the art, typical combat wear over person armor includes vests designed to hold and carry combat tools. Combat worn clothing webs of various types are prevalent, such as for example, MOLLE web loops, pals webbing, and 1-inch webbing (typically sewn in 1¼" spaced apart seems). In embodiments where the tool handle is, for example, 10 to 12 inches long, the tool can typically engage 6 loops for secure storage and transport.

Figure 9:
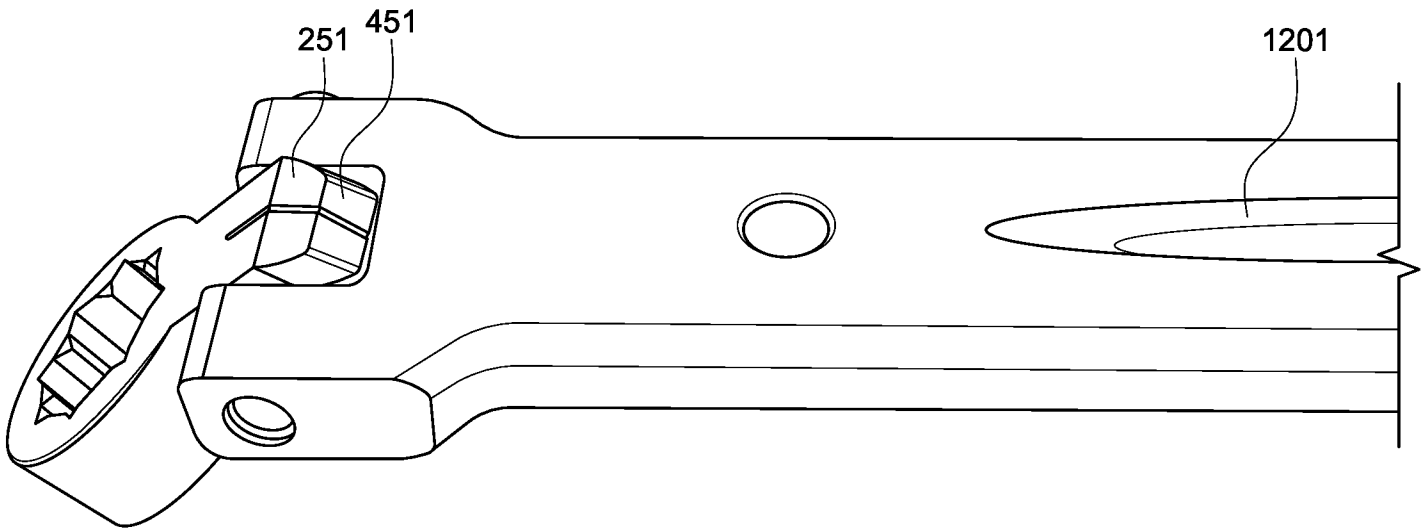
FIG. 9 is a drawing showing one embodiment of a combat vehicle rescue tool having an exemplary dished out section.

Alternative handles: Dished out handle or handle with relief (cut out) openings: FIG. 9 is a drawing showing one embodiment of a combat vehicle rescue tool having an exemplary dished out section 1201. The dished out section 1201 can be continuous and of any suitable shape. For example, there can be a dished out longitudinal channel section. Or, alternatively, there could be patterns (e.g. square, rectangular, elliptical, or circular) of dished out sections. In other embodiments, there can be holes or other openings completely through the handle, such as, for example, square, rectangular, elliptical, or circular holes. One purpose of dished out sections (or cut through sections or holes) is to reduce the weight of the tool. An advantage of a dished out section versus a clear through opening is that there is less chance of the tool getting caught in the carry pocket or carry web or other debris, such as for example, exposed wire or cable ends or thin sections of materials exposed following an explosion near the door of the combat vehicle to be opened. One advantage of clear through openings such as holes or rectangular openings is that a tool lanyard could be affixed (a less common need because the tool generally slides into a combat web), or it may be possible to use the tool handle to bend some loose structure out of the way by placing a steel wire, for example, through a hole in the handle and bending it out of the way using the handle.

Tubular Handle: In some embodiments there can be a tubular handle. The tubular handle can be made from any suitable material, such as for example, any suitable metal, fiber glass, fiber glass with metal strands, carbon composite, or ceramic tube, such as made from an alumina ceramic. For example, during testing a fiberglass metal strand material based tube was found to be suitable for use in a combat vehicle rescue tool as described hereinabove.

Figure 10:
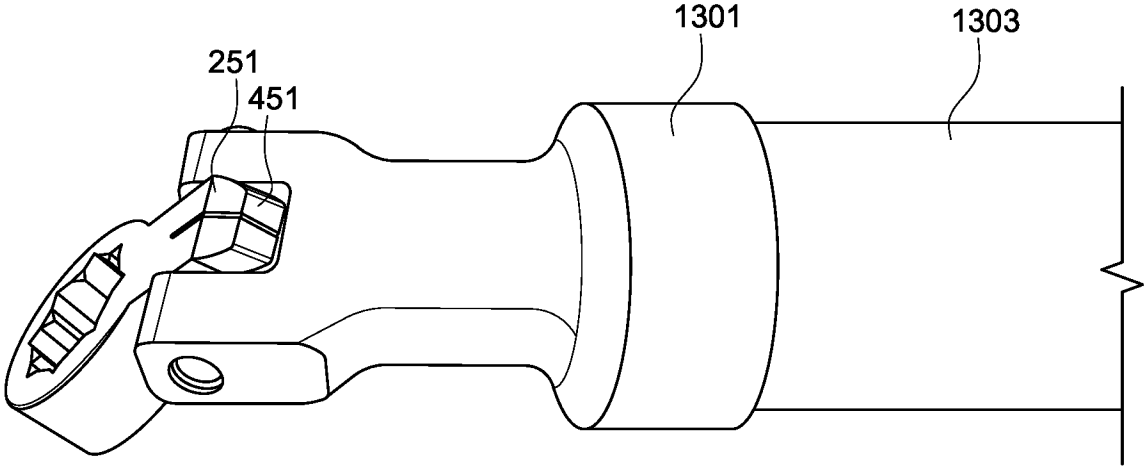
FIG. 10 shows an exemplary cylindrical end where a female cylindrical end assembles over the outside surface of a tubular handle.

In some embodiments, a combat vehicle rescue tool having a tubular handle can be a two-piece structure. The tubular handle can accept a male or female tool end or coupling section, typically cylindrical end, or cylindrical coupling section. The cylindrical end can be tubular with an open interior, where a female cylindrical end assembles over the outside surface of a tubular handle. FIG. 10 shows an exemplary cylindrical end where a female cylindrical end 1301 assembles over the outside surface of a tubular handle 1303.

Figure 11:
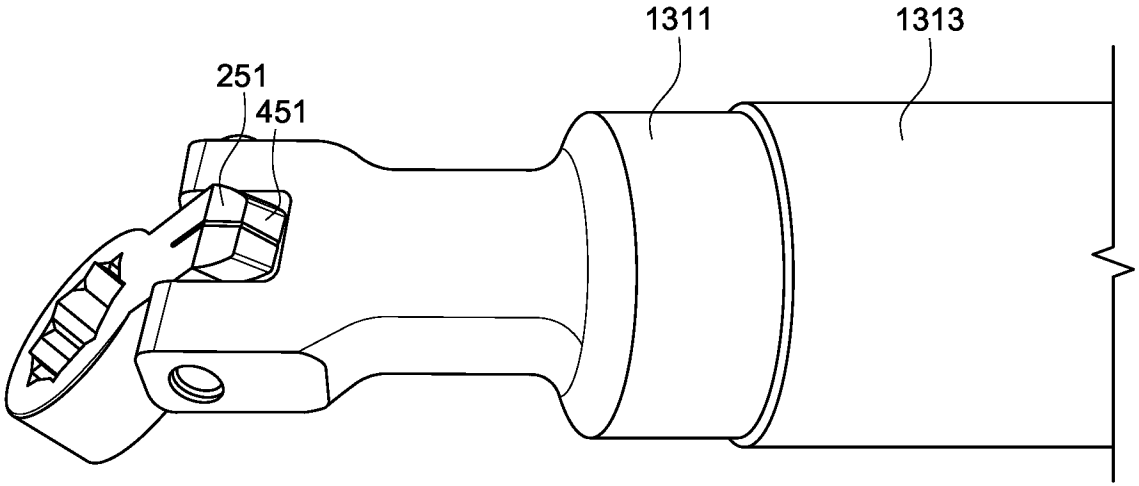
FIG. 11 shows an exemplary male cylindrical end which assembles into the inside surface of a tubular handle.

Or, the cylindrical end can be tubular with an open or closed interior, where a male cylindrical end assembles into the inside surface of a tubular handle. FIG. 11 shows an exemplary male cylindrical end 1311 which assembles into the inside surface of a tubular handle 1313.

The sections of such two-piece structures can be combined by any suitable adhesive, glue, welding, bonding, or threading technique. Further, the sections can be pinned by any suitable pin, screw or bolt.

Detent mechanism: Detent mechanisms include any suitable mechanism which holds the end wrench in any angle as defined by a flat of the end wrench assembly, such as the flats on the end of a rectangular stem as described hereinabove. In other words, any of three or more flats of the stem of the end wrench provide and act as a catch mechanism to bias the end wrench to a preferred angle as defined by the angle of each flat.

For example, in place of a spring biased ball, or spring biased post with a ball end, acting against a channel (FIG. 3), there could be post with a pointed end. Or, in other embodiments, there could be one or more leaf springs, where each leaf spring is typically anchored at one end, such as, for example, a U shaped, bow shaped, or rectangular shaped leaf spring that biases the end wrench into a fixed angle as defined by the three or more flats on the end wrench stem.

Friction mechanism: It is contemplated that there could also be embodiments where the end wrench angle is fixed by a frictional technique. For example, there could be any suitable compressible material deposited in a sufficient thickness along the surface of the forked opening, such as the surface through which the exemplary detent rod of FIG. 2A and FIG. 3 extends. Because the compressible material is more compressed at end wrench angles between the angles defined by the flats, the end wrench will be biased to an angle corresponding to any of the three or more flats when the end wrench is so positioned at one of those preferred angles. Suitable compressible materials include rubber, natural and synthetic elastomers, and any other suitable elastomeric or compressible material that can be affixed to the lower surface of the forked opening. There could alternatively or additionally be such a compressible material affixed to each of the flats or the entire surface including all of the flats of the stem of the end wrench itself.

Figure 12:
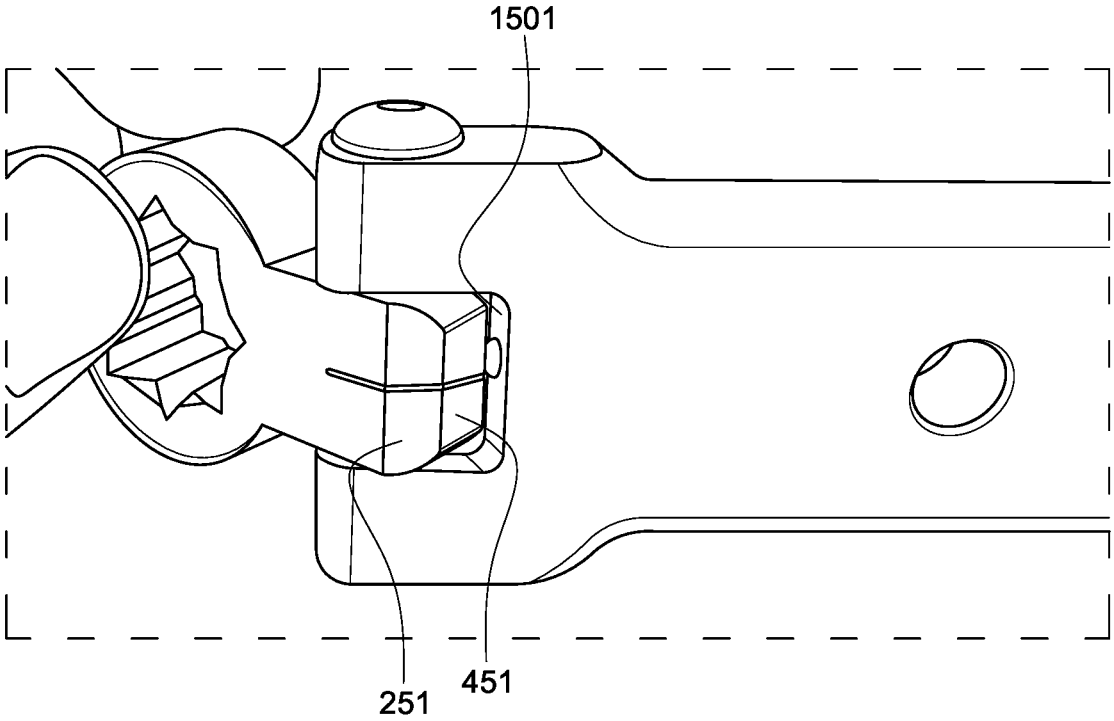
FIG. 12 is a drawing showing one exemplary embodiment of a compressible material on the center surface of the opening of the fork.

FIG. 12 is a drawing showing one exemplary embodiment of a compressible material 1501 mechanically coupled or affixed by any suitable means to the center surface of the opening of the fork to frictionally bias the end wrench into one of several end wrench angles as defined by three or more flats of the stem of the end wrench.

Using such frictional techniques, it is contemplated that it may also be possible to provide a stem of an end wrench with many small flats, or even with a contoured curved surface so that in the presence of an opposing frictional material (e.g. a rubber, or other such natural or synthetic compressible material) the end wrench be set to virtually any angle of a number of small incremental detent positions, or effectively set continuously to any desired angle of continuum of angular positions (as there can be many small detents with a small delta angle between each of many small flats). Or, in the limit, there could be only a contoured surface, such as a curve that is opposed by a compressed material such that the end wrench angle is continuously settable to any desired angle, for example, from about −90 degrees to +90 degrees. In such embodiments, the frictional force would be such that a soldier or average strength could set the angle. Alternatively, it is contemplated that in some embodiments, there could be a frictional level or clamp mechanism such that a user of the combat vehicle rescue tool could select an unlocked position to move the frictional surface away from the stem of the end wrench to allow the use to set the desired end wrench angle, and to re-engage with relatively higher frictional force to hold the set end wrench angle. Such levers and/or cam mechanisms for fixing a surface against a frictional surface (e.g. with a compressible material), or for fixing two surfaces, each surface having a compressible (frictional material) against each other are known to those skilled in the art.

Figure 13:
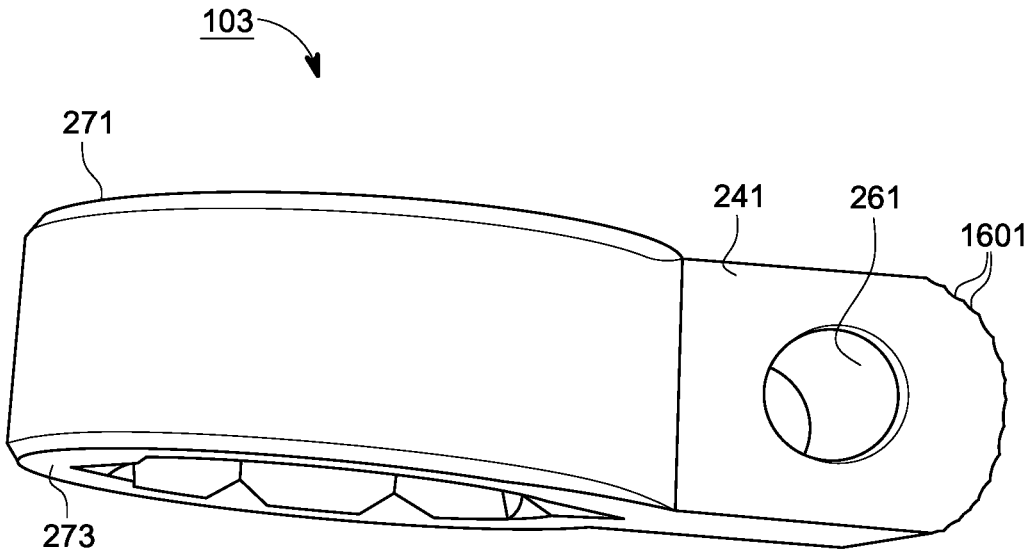
FIG. 13 is a drawing showing one exemplary embodiment of an end wrench have many more than three flats.

FIG. 13 is a drawing showing one exemplary embodiment of an end wrench have many more than three flats 1601, each of which flats can functions as a selectable end wrench angle, such as, for example, as biased by an opposing compressible material, or any other suitable detent mechanism.

Handle materials: The handle can be made from any suitable material. Suitable metals include, for example, aluminum, steel, and titanium and any alloys, or combinations thereof. Also, any suitable non-metals, such as, for example, composites, carbon composites, carbon fiber composites, plastics, thermoplastics, nylon, glass filled nylon, acrylic, polyethylene, polypropylene, polyurethane, polytetrafluoroethylene (PTFE), poly(methyl methacrylate) (PMMA), low-density polyethylene (LDPE), high-density polyethylene (HDPE), or polyethylene terephthalate, poly (ethylene terephthalate) (PET) may be suitable materials, or combinations thereof. Manufacturing can be done, for example, by injection molding, acrylic injection molding, PTFE Injection Molding, PMMA injection molding, LDPE injection molding, HDPE injection molding, PET injection molding, or by glass filled injection molding. It is contemplated that some softer materials may be suitable when combined with fibers or strands of materials or other chemical hardeners to provide enough rigidity to function as a combat vehicle rescue tool handle. Some softer plastics alone may also be less suitable for use as a handle material. However, in some embodiments, there could also be a handle with a softer outer layer, particularly for ergonomic reasons.

Handle finishes: The handle can have any suitable finish. The finish can have many purposes. For example, for some combat applications, particularly for special forces (SF), it is desirable that the finish have low light reflectivity, such as a non-reflective black finish. The finish may also enhance gripping ability, such as a slightly rough finish, or enhance sliding in and out of the kit webbing as a smoother finish. The finish can also be used to prevent some forms of oxidization, such as rust where parts of the end wrench are typically made from a steel. Or, an oxidation, such as an aluminum oxidation treatment of an aluminum handle can inhibit further corrosion of the handle. Suitable finishes include, for example, anodizing, bluing, baked on enamel, Cerakote, Parkerized, powder coating, plating, deposited materials, electroplating, painting, or machining (e.g. a knurled surface).

Figure 16:
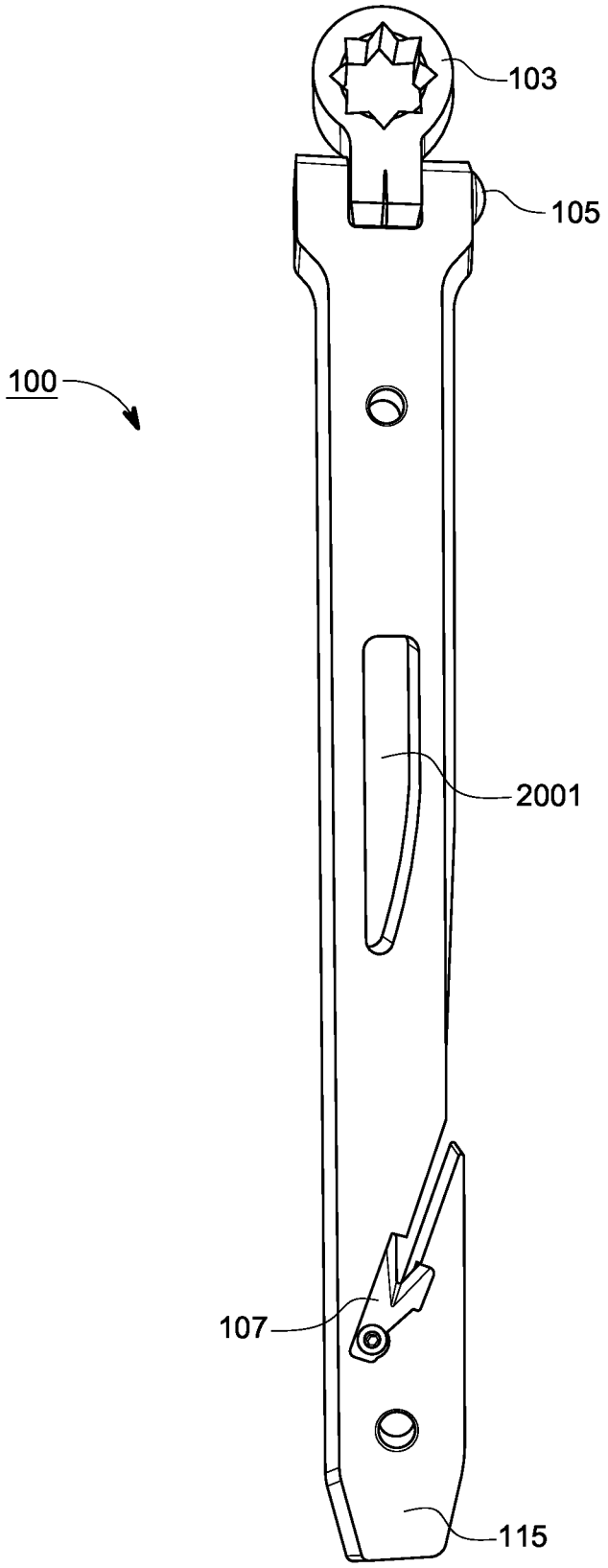
FIG. 16 is a drawing illustrating an exemplary tool handle including a shackle key.

Relief cut in handle as a tool: In some embodiments, there could be a cut, typically a cut through the handle of the tool. For example, a slot in the handle could engage a flat head of a bolt to turn the bolt (e.g. to open a shackle or clevis). FIG. 16 is a drawing illustrating a tool handle with a shackle key 2001. The through cut could also be, for example a shackle key shape 2001 as is well known in the art. Such shackle key shapes can have any suitable opening ranging, for example, from a three-sided triangular opening with curved corners as shown in FIG. 16 to variation such as a bend in one of the triangle sides. In other embodiment, it is contemplated that there could be a through slot (e.g. a rectangular slot, or a rectangular slot with rounded ends and/or corners) which can engage to turn a flattened head of a bolt. Other such openings or slots to engage rotatable hardware are contemplated to fall within the scope of the description.

There can also be embodiments of a combat vehicle rescue tool where the end of the tool handle opposite the end wrench has other useful tool ends in addition to, or in place of the belt cutter. For example, it is contemplated there could be a tool handle similar to the form of a marlin spike, as a shackle pin removal tool. FIG. 17 shows an exemplary contemplated tool handle in the form of a shackle pin removal tool 2101. Shackle pin removal tool can be used, for example, to open shackles, such as shackles on combat vehicles. Also, shackles are commonly used to secure combat vehicles to ship decks during transport.

While the emphasis of the combat vehicle rescue tool described hereinabove is on military and combat applications, it is understood that there will also be civilian applications, such as, for example, where police forces use such vehicles in civilian law enforcement roles.

A rescue tool of the prior art which might not always be able to properly engage a rescue mechanical coupler, especially where superstructure may have bent due to a crash or other combat damage preventing straight-on access to the mechanical coupler.

Spare fastener post—As described hereinabove, FIG. 6 shows another style of a knurled head fastener post 605 having threads 615 which can engage the threaded cylindrical wall 205 of fork 111 of handle 101. A knurled head fastener post 605 can be accessed quickly by hand or manual operation to change an interchangeable end wrench 103.

Particularly during a difficult combat rescue, the fastener post might be dropped, damaged, or lost. I realized that a spare fastener post can be stored in any suitable hole in the handle with threads towards the bottom of the hole. For example, the hole can be in the end of the tapered end of handle, where the spare fastener post can be secured by threaded engagement. Moreover, the relatively hard end of the exposed fastener post can be used to break glass, such as might be needed for a rescue from a light duty truck or civilian car, such as also might be damaged in an IED explosion.

Figure 18A:
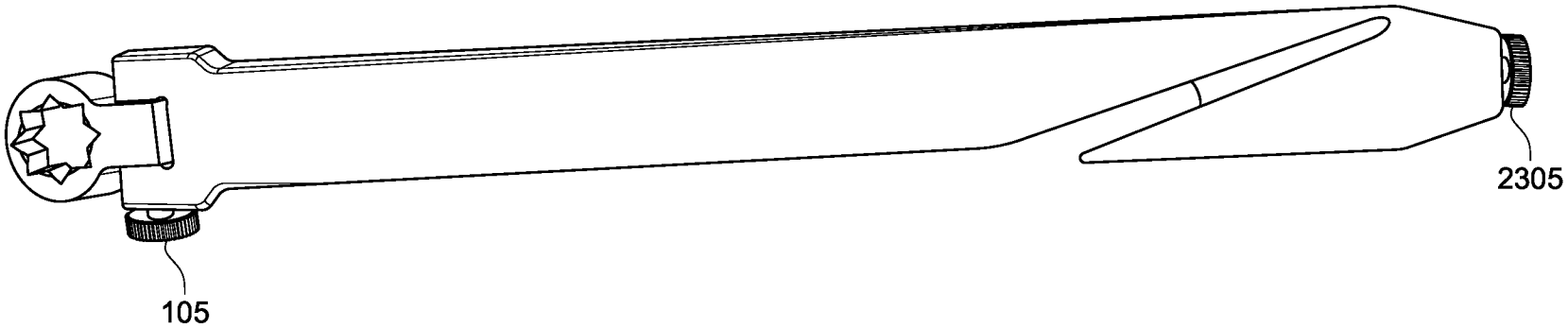
FIG. 18A is a drawing showing a combat vehicle rescue tool according to the Application with a spare fastener post shown installed into a hole in the tip or end face of the tapered end of the tool handle.

FIG. 18A is a drawing showing a combat vehicle rescue tool according to the Application with a spare fastener post 2305 shown installed into a hole in the tip or end face of the tapered end of the tool handle. The hole can be defined by a cylindrical wall which is threaded in whole, or more typically in part. Threads of a threaded hole can be present at the deepest portion of the hole, so that a fastener post, such as for example, a knurled head fastener post 605 having threads 615 can threadingly engage as the fastener post is mostly inserted into the hole.

Figure 18B:
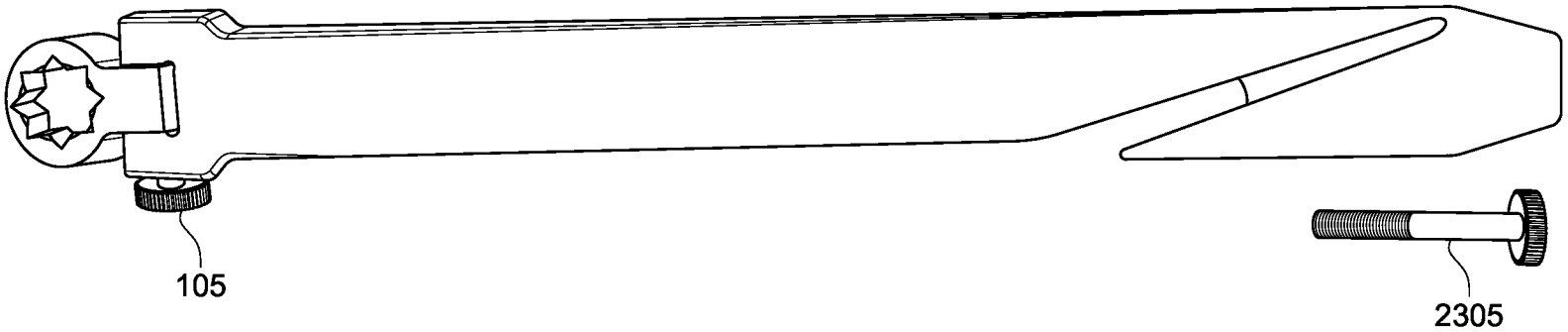
FIG. 18B is a drawing showing a combat vehicle rescue tool according to the Application with a spare fastener post removed from the handle and ready for use in the forked arms to rotatingly secure the rectangular stem within and between the forked arms.

FIG. 18B is a drawing showing a combat vehicle rescue tool according to the Application with a spare fastener post 2305 removed from the handle and ready for use in the forked arms to rotatingly secure the rectangular stem within and between the forked arms. Mounting the spare fastener post in the tip of the tool also helps prevent snags on the MOLLE loops.

Figure 18C:
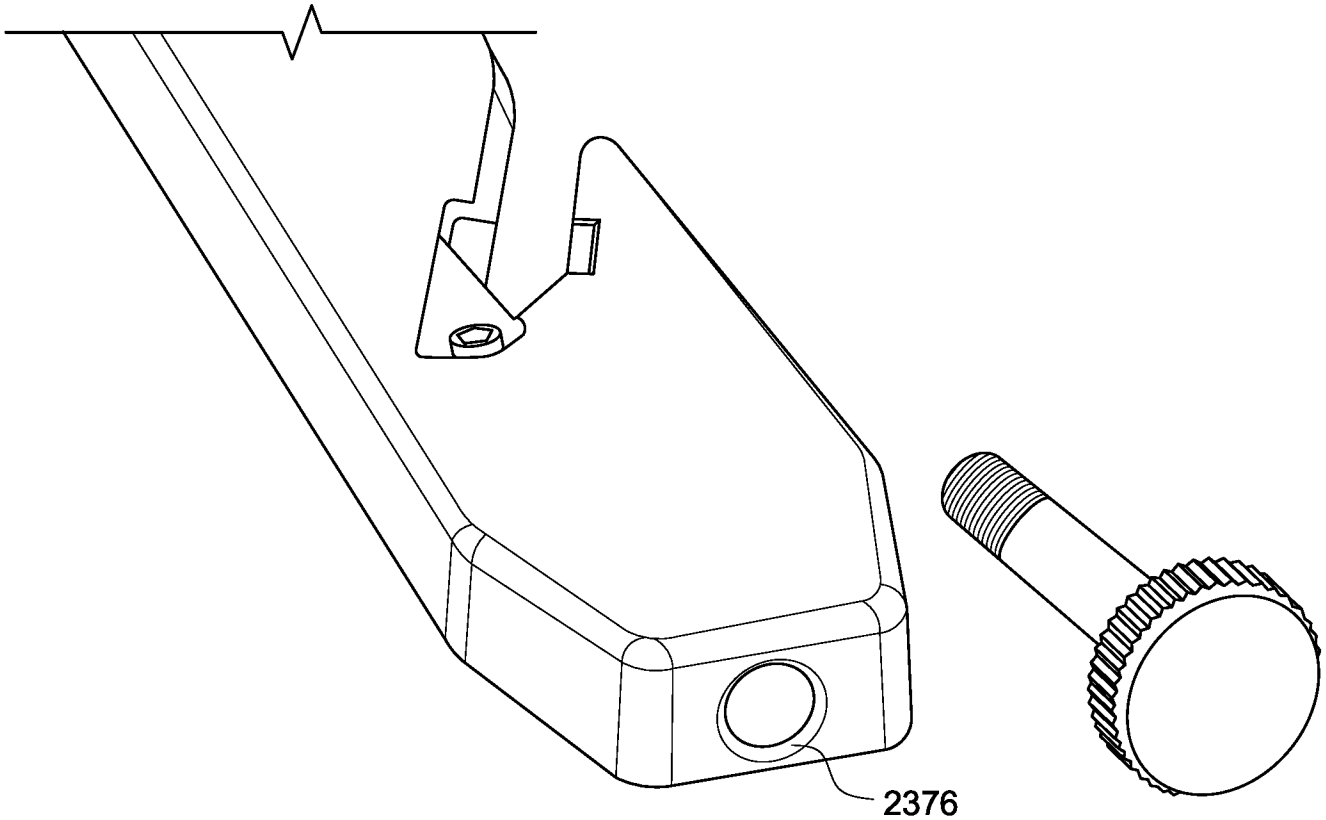
FIG. 18C is a drawing showing another combat vehicle rescue tool according to the Application with a spare fastener post removed from the handle.

FIG. 18C is a drawing showing another combat vehicle rescue tool according to the Application with a spare fastener post removed from the handle. The partially threaded receptacle for the spare pin is part relatively smooth cylindrical wall followed by a deeper threaded section (threaded section not visible in FIG. 18C). There can also be a bevel 2376 to help located the spare fastener post into the hole in the end of the handle. A combat vehicle rescue tool of FIG. 18A can have the spare fastener post partially installed into the handle as the spare fastener post is threadingly inserted into the hole in the end of the handle. The combat vehicle rescue tool of FIG. 18A with can have the spare fastener installed into the handle.

Tapered end of handle—The tapered end of the handle can have tapered side surfaces which typically extend to an end of about half the width or less of a width of each of the two wide surfaces.

Figure 19:
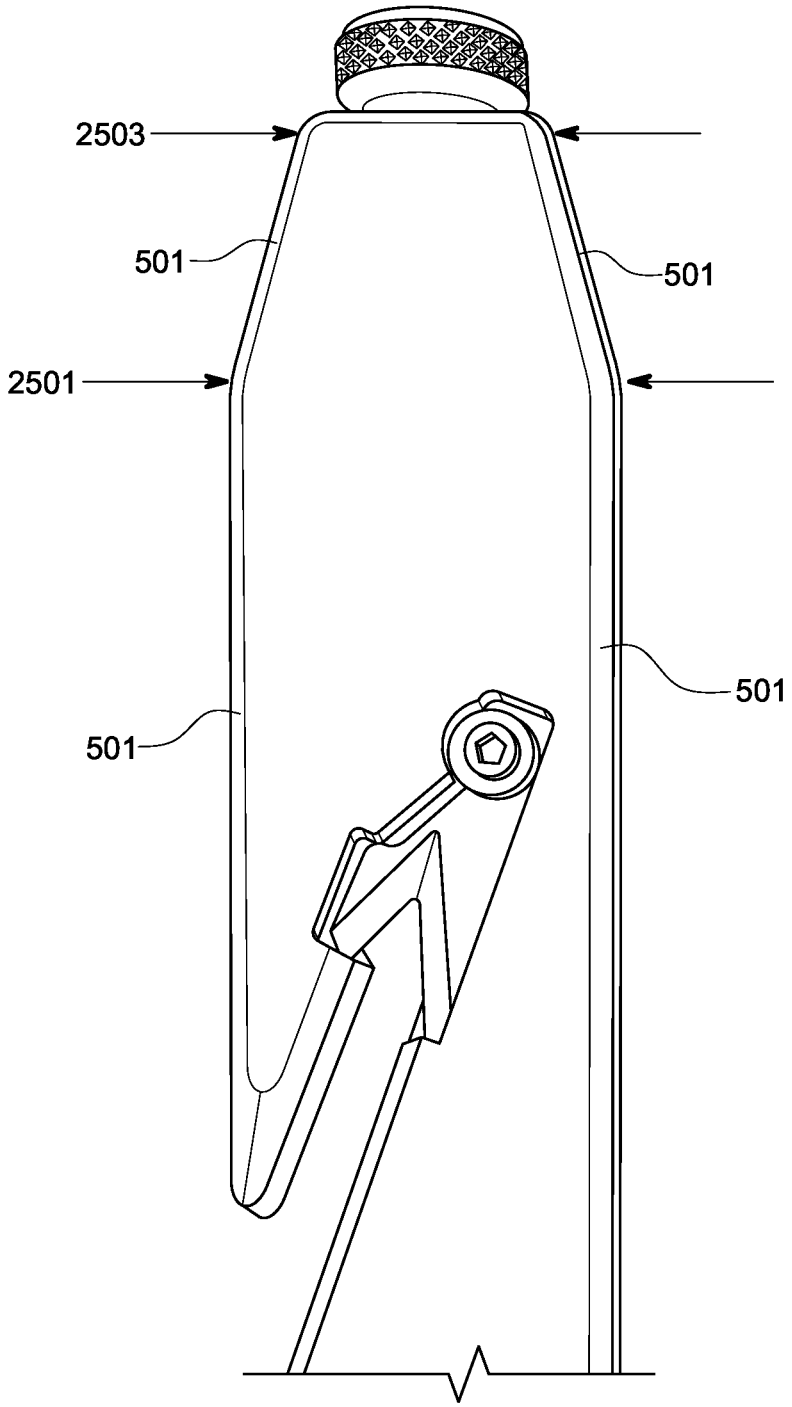
FIG. 19 is a drawing showing an exemplary tapered end of the handle.

FIG. 19 is a drawing showing an exemplary tapered end of the handle. The width 2501 of the exemplary handle is about 1" wide. The narrowed end width 2503 is about ½" wide. However, the handle can be narrowed by any suitable width from about 25% to 75% of the handle width before the taper begins (e.g. width 2501, about 1" in the example).

The rounded corners 501 make it easier to slide the tool through storage loops, such as MOLLE loops on a vest or bag. The taper also makes it easier and faster to stow the tool into and through a series of MOLLE loops. Also, sharp edges might damage the MOLLE loops over time, as the tool is intended to be carried on every MRAP deployment by as many soldiers an contractors as possible.

Storing and Carrying the Combat Vehicle Rescue Tool in MOLLE Loops

Figure 20:
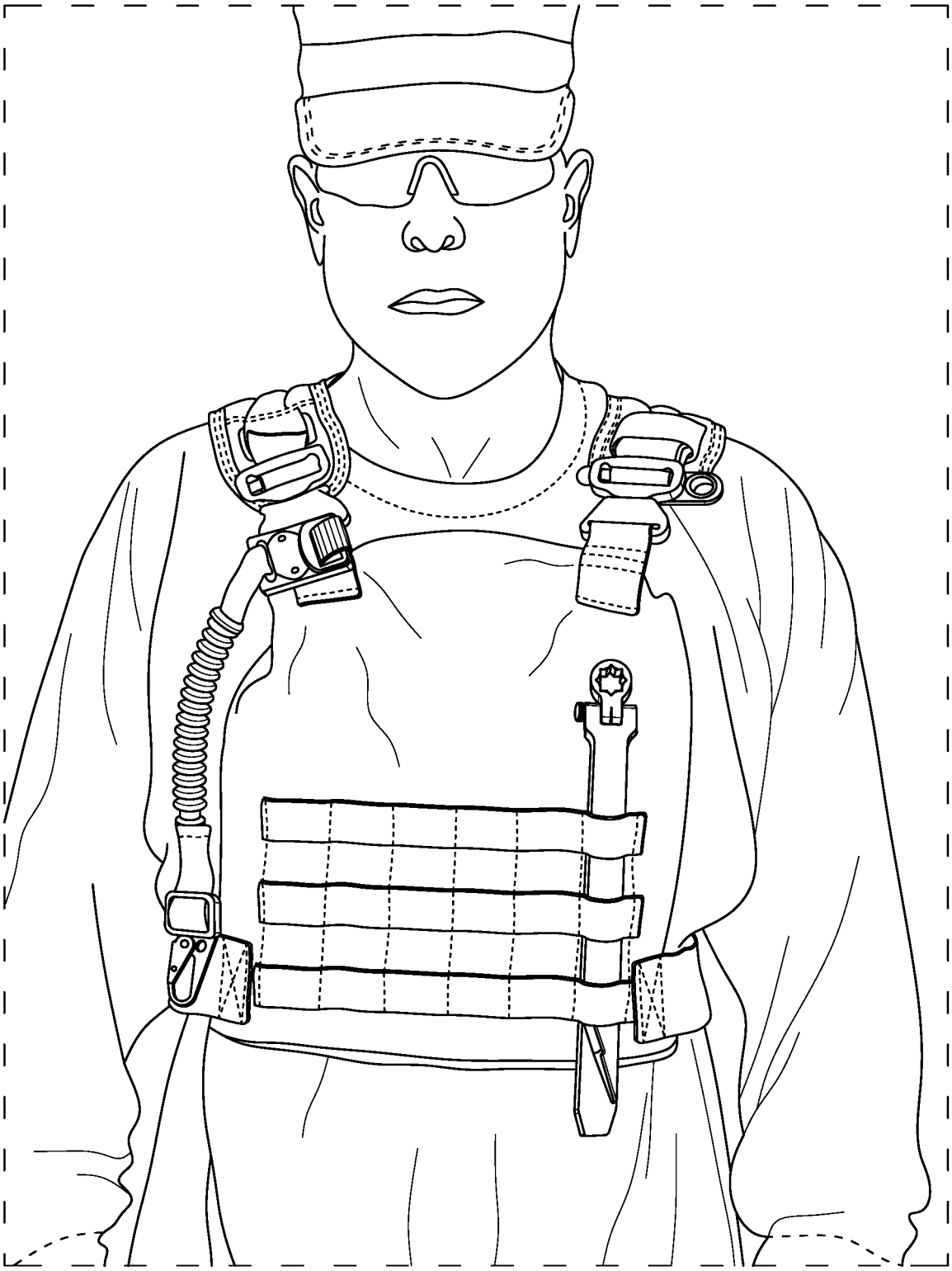
FIG. 20 is a drawing showing the combat vehicle rescue tool carried in the loops of a plate carrier.
Figure 21:
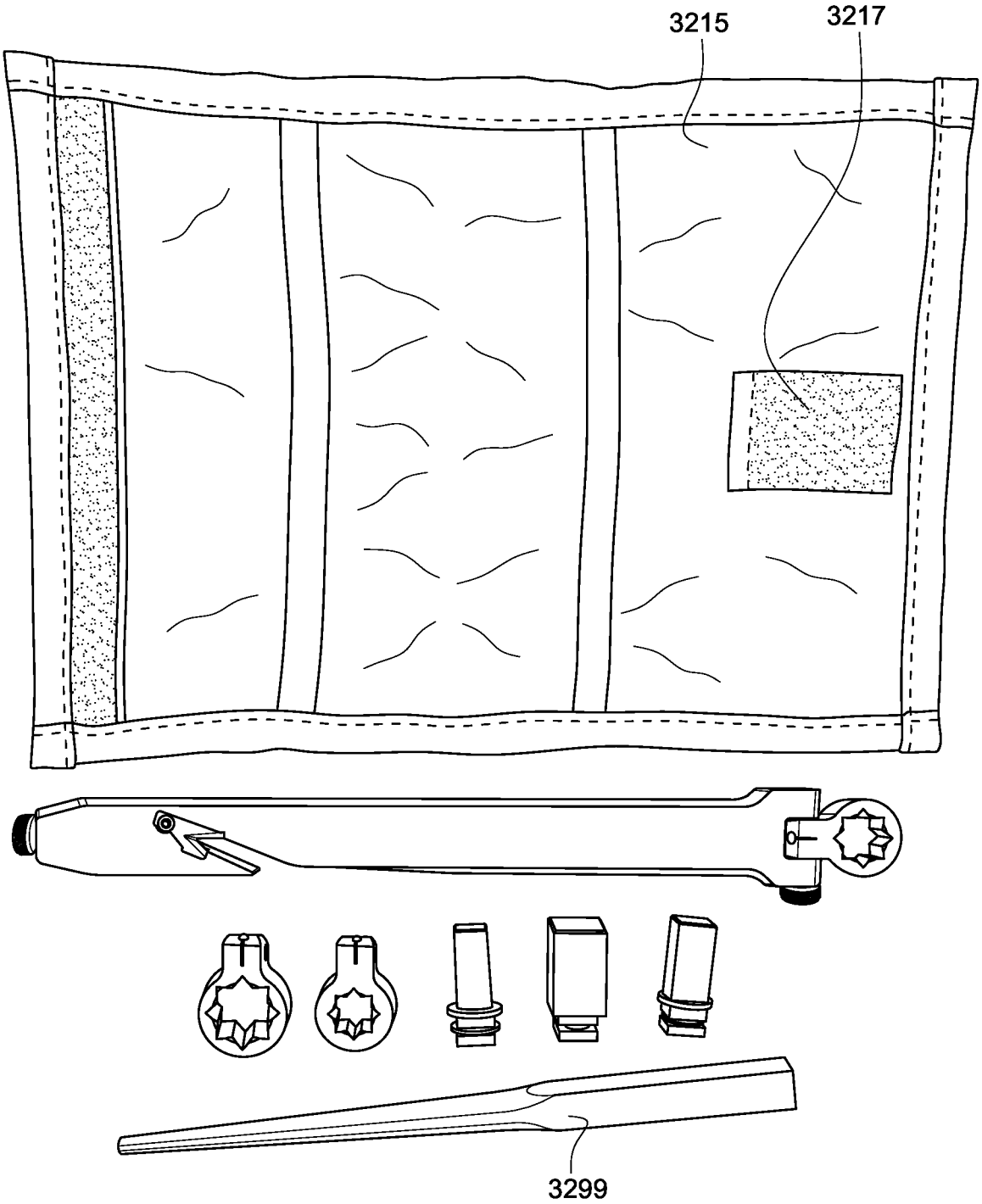
FIG. 21 shows a combat vehicle rescue tool according to the Application which can be stored in bag.

FIG. 20 to FIG. 21 are drawings showing the combat vehicle rescue tool in MOLLE loops for various storing and carrying configurations. FIG. 20 is a drawing showing the combat vehicle rescue tool carried in the loops of a plate carrier. The combat vehicle rescue tool can be carried in the loops of a body armor. The combat vehicle rescue tool can be carried in the loops of a combat vest. The combat vehicle rescue tool can be carried in the loops of a rucksack. The combat vehicle rescue tool can be carried in the loops on the narrow side of a VIC trauma bag.

The combat vehicle rescue tool can also be carried in a separate bag. For example, FIG. 21 shows a combat vehicle rescue tool according to the Application which can be stored in bag 3215, and secured, for example, by loop 3217. There can be a separate shackle pin removal tool 3299 carried in the same kit. A shackle pin removal tool can be used to push a pin out of a shackle and/or placed in round hold of a threaded shackle bolt to unscrew it to open the shackle, as well as for its conventional use in rope and knot work. The shackle pin removal tool 3299 can fit into one of the box wrenches.

Figure 22A:
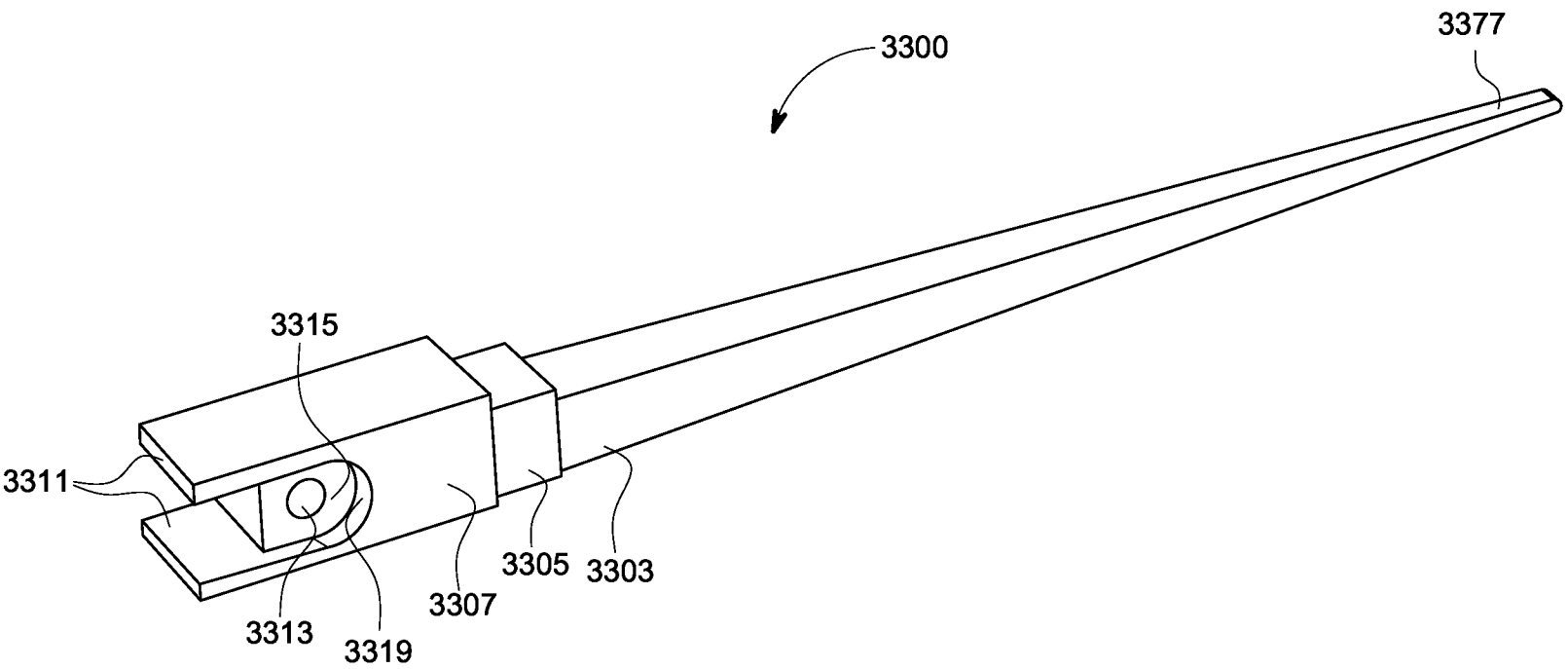
FIG. 22A is a drawing showing an isometric view of an exemplary shackle pin removal tool.
Figure 22B:
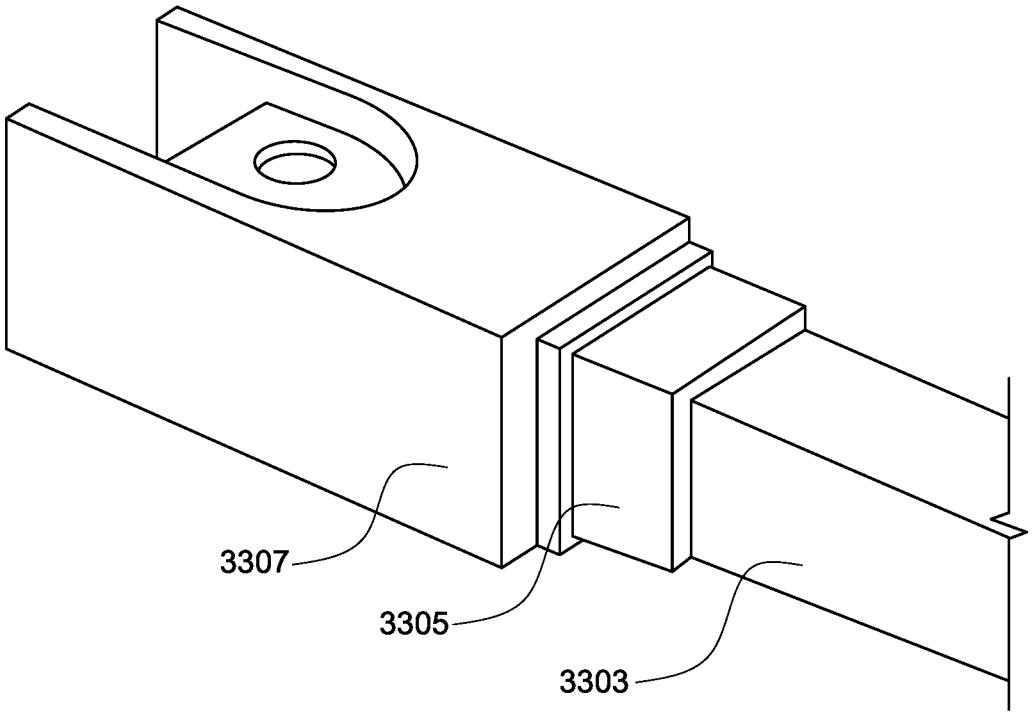
FIG. 22B is a drawing showing more detail of the shackle pin removal tool of FIG. 22A.
Figure 22C:
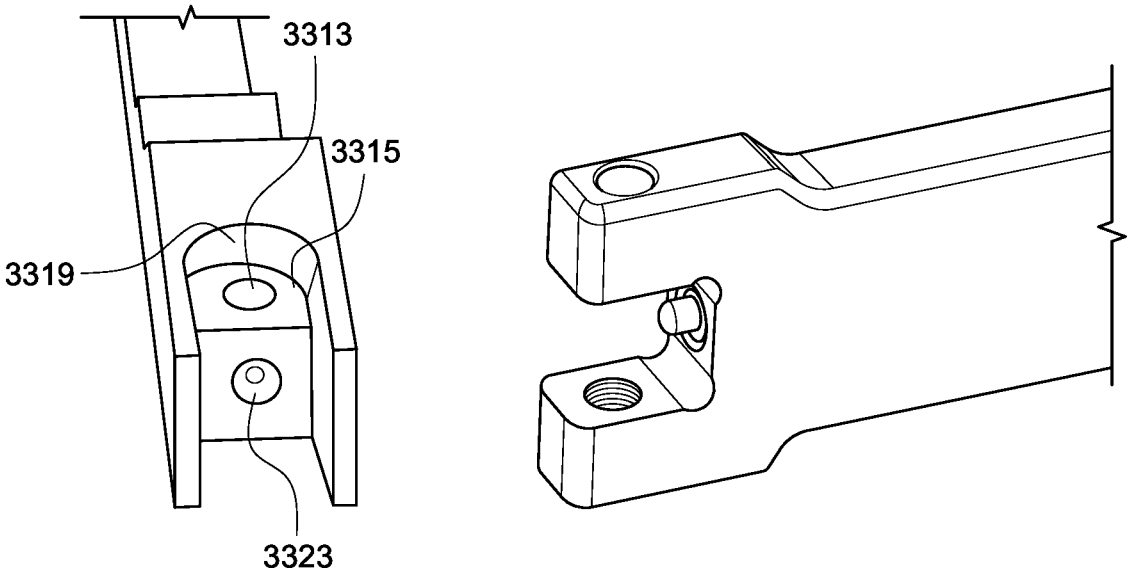
FIG. 22C is a drawing showing the end of shackle pin removal tool of FIG. 22A which can be affixed between the side forks of the handle in place of a box wrench.
Figure 22D:
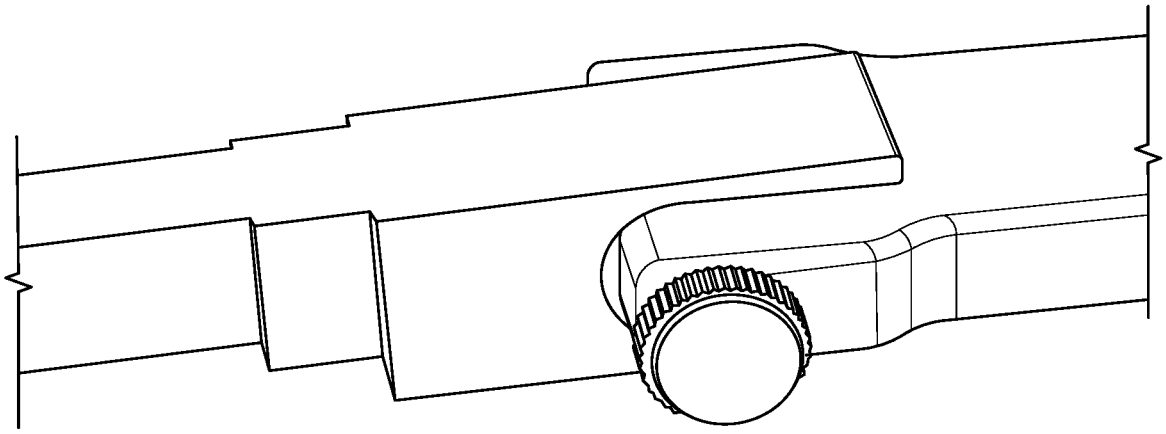
FIG. 22D is a drawing showing the shackle pin removal tool of FIG. 22A affixed between the side forks of the handle in place of a box wrench.
Figure 22E:
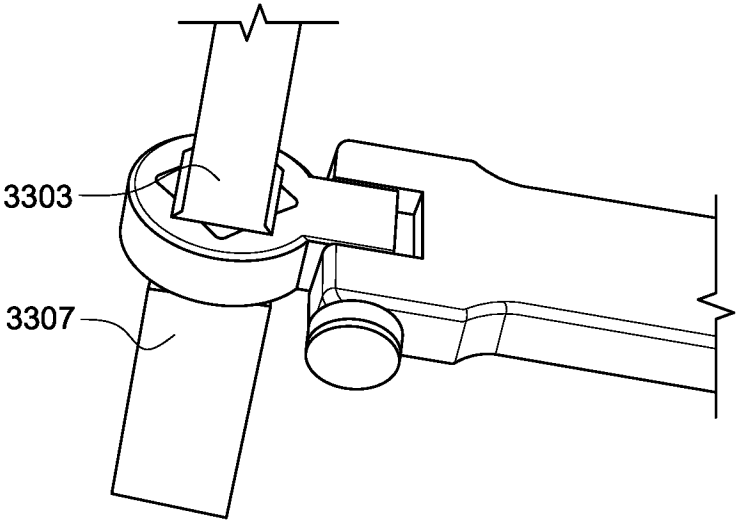
FIG. 22E is a drawing showing shackle pin removal tool inserted into a medium sized box wrench.
Figure 22F:
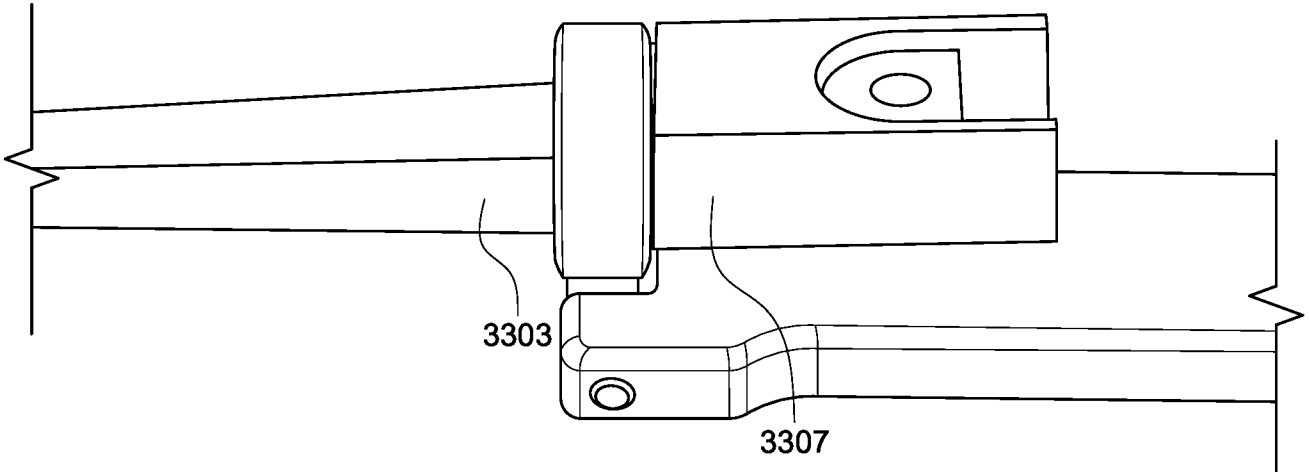
FIG. 22F is a drawing showing the shackle pin removal tool used in line with the longitudinal axis of the handle, where the box wrench is at 90 degrees to the handle.

Shackle pin removal tool—An improved shackle pin removal tool 3300 is shown in FIG. 22A to FIG. 22F. Shackle pin removal tool 3300 can be used by affixing the shackle pin removal tool 3300 to the end of the handle in place of a box wrench (FIG. 22C-FIG. 22D). Or, the shackle pin removal tool 3300 can be slid into the individual box wrenches (FIG. 22E-FIG. 22F).

Affixing the Shackle Pin Removal Tool 3300 to the End of the Handle—

FIG. 22A is a drawing showing an isometric view of an exemplary shackle pin removal tool 3300.

FIG. 22D is a drawing showing the end of shackle pin removal tool of FIG. 22A which can be affixed between the side forks of the handle in place of a box wrench. FIG. 22D is a drawing showing the shackle pin removal tool of FIG. 22A affixed between the side forks of the handle in place of a box wrench.

The wings 3311 extend over the handle when assembled (FIG. 22D). Recess 3315 defined by the recess wall 3319 provides an opening and landing area for each of the side forks 213 of the handle (FIG. 22D). Dimple 3323 provides an opening in the shackle pin removal tool 3300 for Spring biased rod 488 with round tip. Cylindrical wall 3313 defines a hole to accept the knurled head fastener post 605 having threads 615.

Shackle pin removal tool slid into a box wrench—FIG. 22B is a drawing showing more detail of the shackle pin removal tool of FIG. 22A. There are three sized squares large square 3307, medium square 3305, and small square 3303. In the exemplary shackle pin removal tool 3300, all three squares 3307, 3305, and 3302 share a common side wall. Each of the squares 3307, 3305, and 3302 is sized to fit a different sized box wrench. For example, FIG. 22E is a drawing showing shackle pin removal tool 3300 inserted into a medium sized box wrench which engages square 3305 (not visible in FIG. 22E as covered by the box wrench). The shackle pin removal tool 3300 can be used at any box wrench angle (90 degrees to the handle in FIG. 22E). FIG. 22F is a drawing showing the shackle pin removal tool 3300 used in line with the longitudinal axis of the handle, where the box wrench is at 90 degrees to the handle. Any suitable selectable box wrench handle can be used.

Shackle pin removal tool tip 3377—The prototype shackle pin removal tool shows a relatively sharp tip. However, more typically, the end would be rounded over for carry safety.

Shackle pin removal tool sides—It has been found that squared sides are less likely to bind in the shackle over rounded sides or a round cone shape. However, any suitable side shape can be used.

Shackle pin removal tool material—The prototype was made from aluminum. However, more typically, the shackle pin removal tool can be made from a hardened steel. A steel shackle pin removal tool would not suffer aluminum dents shown in the drawings of the prototype.

Shackle pin removal tool carry—The shackle pin removal tool would more typically be carried in a bag or carry case (e.g. FIG. 21). However, there could be slight rounds on the flat sides to be more suitable for carry in MOLLE loops.

Applications and Problems Solved

Figure 14:
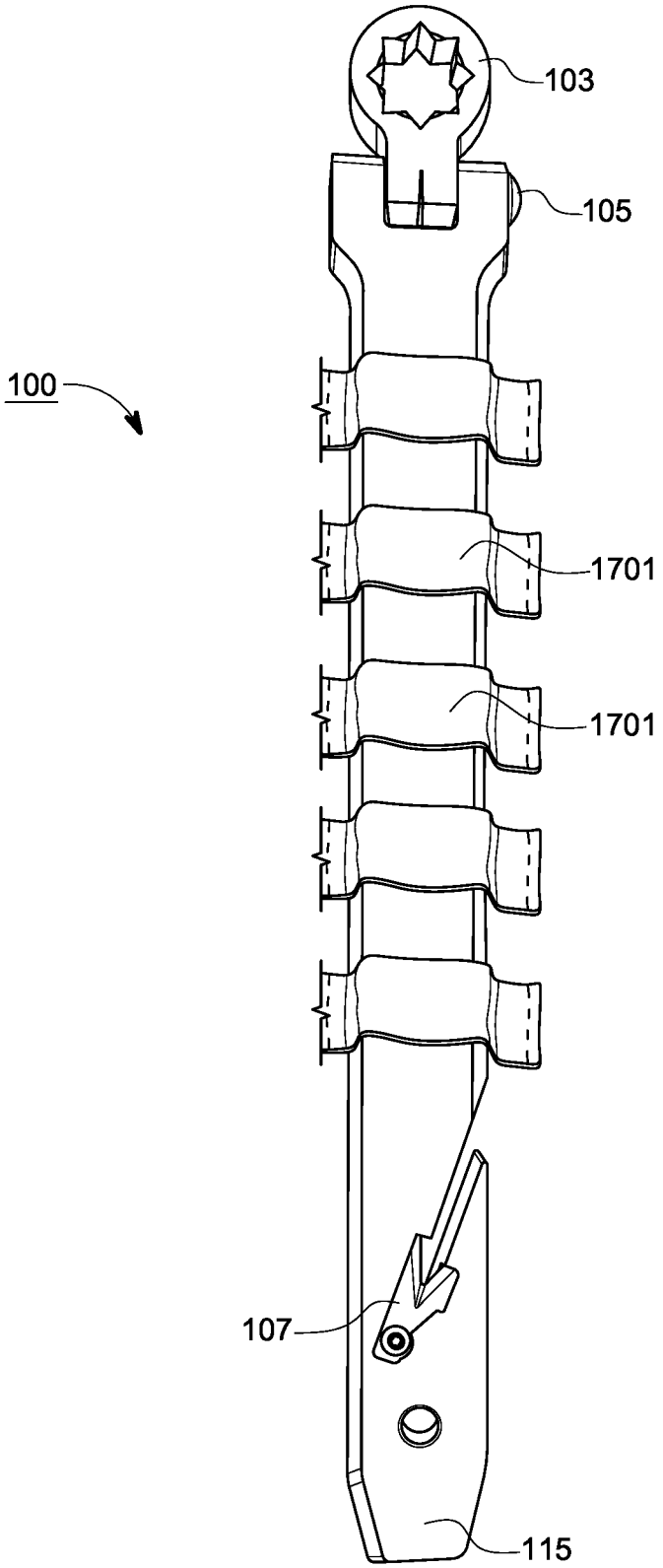
FIG. 14 is a drawing that shows an exemplary combat vehicle rescue tool held to a vest by a plurality of web straps.

As shown hereinabove in FIG. 14, the tapered or pointed end 115 is configured for fast and easy insertion through a plurality of MOLLE loops of a combat vest. One important aspect of the new combat vehicle rescue tool for operating a combat lock is for soldiers and military contractors to have immediate and easy access to the tool when worn on their own personal combat vest.

Before the new combat vehicle rescue tool of the Application, there were two standard issue MRAP rescue tools which could be used to open the combat locks of the MRAP.

The most common U.S. DOD issued tool is too heavy and cumbersome to routinely carry and is typically stored in a locked exterior box of the MRAP. One problem is that combat or mine/IED explosions might cause the MRAP to roll over on the side where the box is, trapping the box under the vehicle. Another problem is that the exterior box is locked and typically only one member of the team can readily access the key to the box.

Some MRAPs carry a tire iron like tool with four different MRAP lock heads, typically specified per regulations to be secured to the left rear portion of the vehicle. Just like the tire irons that were carried in civilian cars, they are big and heavy. This tool was often lost when the plastic ties securing it to the vehicle inadvertently failed, or the tool was commonly stolen from unattended vehicles. Also, depending on the direction from which incoming fire is coming from, the back of the vehicle might be less accessible following a combat incident.

One of the problems solved by the new tool is that the relatively light weight tool can be carried by several or all personnel of the MRAP crew and others allied forces in the vicinity. In fact, the tool can be a standard issue carry item, "one of the things they carry", just as common as the standard issue service pistol. The tool solves a critical need, where any of a number of personnel near a severely damaged MRAP can simply slide the tool out of their own combat vest and open the damaged MRAP door one handed to affect a rescue, which is often done in the midst of incoming rifle rounds, and grenades (RPGs). The tool is equally relevant for civilian police special emergency response team's use of MRAPs, such as for active shooter or terrorist attack situations.

A typical MRAP vehicle includes an installed RPG steel netting. There is a physically restricted access area to the combat lock through a relatively small opening in the RPG netting.

MRAP vehicles have been in service around the world since about the 1970's, and more specifically were introduced to U.S. armed forces by about 2004, then in large numbers around about 2007 following the increase in attacks involving road side bombs and improvised explosive devices (IEDs). Currently there are more than 35 variants in use by more than 10 different countries.

The MRAP combat locks are vital to safety and security. The combat locks also keep the doors from popping open in case of overpressure from a blast. While traveling at low speeds through populated areas, the combat locks prevent access to the inside of the vehicle by enemy actors, who try to open the doors to throw hand held explosive devices into the MRAP with the intent of wounding or killing the occupants.

The circle 3401 shows an access point, where following installation of RPG nets, it is no longer possible to get two handed access to the combat lock to efficiently use existing rescue tools. The lock to the left of the soldier at approximately shoulder height, on the same vertical plane as the combat vehicle mirror, below the shackle. The opening in the RPG net is about 4"×6" inches where it is also impossible to get two hands in the holes and the 4-way tire iron version will not fit either.

Yet, despite decades of use and increasingly difficult rescue situations (The current DOD issued tools, either stowed in the outside BII box or secured to the outside) cannot be operated with the RPG netting installed along the outside of the MRAP in place, either intact or damaged from a blast because of the size of the existing access hole. Thereby requiring the removal of the netting subsequently requiring more time and delaying rescue efforts where mere seconds lost could make the difference between a rescue and recovery.

The current issue DOD Universal Combat Lock Tool (UCLT, NSN 2540-01-574-0491) is over 16" long closed, by 3.5" wide, with an arm over 10". The UCLT is 25" long fully opened.

The tool requires a two handed operation and weighs approximately 7 pounds, far too heavy and large to carry at all times with other standard carried gear. The attached ARMY instruction tells soldiers to stow the tool in the vehicle's exterior "BII stowage box". Also, if the rescuer needed to cut the occupant restraints (a situation which is highly probable given the circumstances requiring employment of the UCLT) a separate cutting tool is required.

Yet another problem with the UCLT is that so many of the tire iron versions and even the UCLT have been stolen, necessitating the shapes of the locks to be changed for security purposes. For example, the UCLT shown above is for sale on eBay. This DOD UCLT will no longer open several versions of active combat MRAP doors which have since been "re-keyed" with new shapes. Whereas the proposed tool just needs the addition of a new head manufactured to fit the new lock instead of manufacturing a whole new tool thereby reducing cost and decreasing the time it takes to field the new "key" in a dynamic combat environment.

I invented the new combat tool of the Application while in the combat theatre (Afghanistan) following an incident where the UCLT was locked in the tool box on the side of the vehicle, and the vehicle was overturned onto the exterior tool box. It was common practice to stow the relatively large and heavy UCLT outside the vehicle, as per ARMY directives to keep clutter down as the inside of the MRAP interior is very confined, and where leaving a UCLT in the cab could create a secondary projectile during a rollover or explosion thereby causing either death or serious injury.

The new combat rescue tool as described by the Application is the first practical combat wearable solution where any one of many nearby personnel can open the locked door of a combat damaged and rolled MRAP by pulling the unlock tool from their own combat armor, combat vest, med kit, rucksack, etc.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

I claim:

1. A combat vehicle rescue tool for operating a combat lock to open a door of a combat vehicle by engaging an exterior mechanical rescue coupler comprising:

a handle of said combat vehicle rescue tool, said handle having about a rectangular cross section defined by two wide surfaces and two smaller side surfaces comprising:

a first end extending into a first forked arm and a second forked arm, an inside fork surface of both forked arms defining a substantially rectangular opening, both forked arms including a cylindrical wall defining through-holes perpendicular to a long axis of said handle and sized to accept a fastener pin, and a second tapered end of said handle having tapered side surfaces, each corner of said second tapered end rounded over, said second tapered end configured for passing through a plurality of a combat vest having MOLLE loops for stowage on and removal from said combat vest, and an end face of said second tapered end comprising a cylindrical wall threaded in part to accept a spare fastener pin threadingly engaged within; and a selectable angle end wrench pivotally mounted to said handle by said fastener pin, said selectable angle end wrench comprising a box wrench sized to fit said exterior mechanical rescue coupler of a combat vehicle door, said selectable angle end wrench having a pair of face surfaces, said selectable angle end wrench extending into a rectangular stem having a stem width sized to rotatingly fit into said substantially rectangular opening, said rectangular stem having an end wrench cylindrical wall parallel to a face plane of said pair of face surfaces, said end wrench cylindrical wall defining a hole through said rectangular stem sized to accept said fastener pin, said rectangular stem comprising at least three angled faces on a rectangular stem end opposite to said box wrench.

2. The combat vehicle rescue tool of claim 1, wherein said selectable angle end wrench comprises a spring biased ball or a spring biased rod with a rounded tip or a pointed tip.

3. The combat vehicle rescue tool of claim 1, wherein said selectable angle end wrench comprises an eight-point box wrench.

4. The combat vehicle rescue tool of claim 3, wherein said eight-point box wrench accepts a square mechanical coupler at a plurality of acceptance angles.

5. The combat vehicle rescue tool of claim 3, wherein said eight-point box wrench further includes bevels to guide four of eight points of said eight-point box wrench over a 4-sided square combat lock rescue mechanical coupler.

6. The combat vehicle rescue tool of claim 5, wherein said 4-sided square combat lock rescue mechanical coupler further comprises an O ring disposed in a circumferential slot on a portion of said 4-sided square combat lock rescue mechanical coupler which is removably disposed in said eight-point box wrench to provide a friction hold of said portion of said 4-sided square combat lock rescue mechanical coupler disposed in said eight-point box wrench.

7. The combat vehicle rescue tool of claim 6, wherein said 4-sided square combat lock rescue mechanical coupler further comprises a circular end cap.

8. The combat vehicle rescue tool of claim 5, wherein said 4-sided square combat lock rescue mechanical coupler further comprises an O ring disposed in a circumferential slot on a portion of said 4-sided square combat lock rescue mechanical coupler which is removably disposed in said selectable angle end wrench to provide a friction hold of said portion of said 4-sided square combat lock rescue mechanical coupler disposed in said selectable angle end wrench.

9. The combat vehicle rescue tool of claim 1, wherein said fastener pin includes a threaded end and at least one of said first forked arm or said second forked arm comprises a threaded hole.

10. The combat vehicle rescue tool of claim 9, wherein said fastener pin comprises a machine screw having a head, a smooth cylindrical rod section ending in a threaded rod sized to thread into said threaded hole.

11. The combat vehicle rescue tool of claim 10, wherein said fastener pin comprises a knurled head for manual operation by fingers.

12. The combat vehicle rescue tool of claim 1, wherein said selectable angle end wrench is interchangeable with any one of a plurality of different sized or types of end wrenches.

13. The combat vehicle rescue tool of claim 1, further comprising a seat belt cutter disposed about at an end of said handle opposite said selectable angle end wrench.

14. The combat vehicle rescue tool of claim 13, wherein said seat belt cutter comprises a blade having at least a single knife blade edge or said blade having a pair of angled knife blade edges joined at a common apex.

15. The combat vehicle rescue tool of claim 14, wherein said blade having said pair of angled knife blade edges is bolted onto a recess edge within said handle.

16. The combat vehicle rescue tool of claim 1, wherein said handle comprises an aluminum metal and said selectable angle end wrench comprises a steel metal.

17. The combat vehicle rescue tool of claim 1, wherein said handle further comprises a shackle key.

18. The combat vehicle rescue tool of claim 1, wherein a shackle pin removal tool mounts to the handle in place of said selectable angle end wrench.

19. The combat vehicle rescue tool of claim 1, wherein a shackle pin removal tool slidingly mounts into said selectable angle end wrench.

20. A combat vehicle rescue tool for operating a combat lock to open a door of a combat vehicle by engaging an exterior mechanical rescue coupler comprising:

a handle of said combat vehicle rescue tool, said handle having about a rectangular cross section defined by two wide surfaces and two smaller side surfaces comprising:

a first end extending into a first forked arm and a second forked arm, an inside fork surface of both forked arms defining a substantially rectangular opening, both forked arms including a cylindrical wall defining through-holes perpendicular to a long axis of said handle and sized to accept a fastener pin, and a second tapered end of said handle having tapered side surfaces, each corner of said second tapered end rounded over, said second tapered end configured for passing through a plurality of a combat vest having MOLLE loops for stowage on and removal from said combat vest;

a selectable angle end wrench pivotally mounted to said handle by said fastener pin, said selectable angle end wrench comprising a box wrench sized to fit said exterior mechanical rescue coupler of a combat vehicle door, said selectable angle end wrench having a pair of face surfaces, said selectable angle end wrench extending into a rectangular stem having a stem width sized to rotatingly fit into said substantially rectangular opening, said rectangular stem having an end wrench cylindrical wall parallel to a face plane of said pair of face surfaces, said end wrench cylindrical wall defining a hole through said rectangular stem sized to accept said fastener pin, said rectangular stem having at least three angled faces on a rectangular stem end opposite to said box wrench; and a shackle pin removal tool configured to either replace said box wrench or to be slid into said box wrench, said shackle pin removal tool comprising:

a recess on each opposing side of a base section of said shackle pin removal tool, where each recess corresponds to said inside surface of each of said side forks of said handle, and a hole to accept said fastener pin, where said shackle pin removal tool is configured to removeably mount to said handle in place of said box wrench, and said shackle pin removal tool comprising a plurality of box shapes of different sizes at said base section of said shackle pin removal tool, each of said box size configured to correspond to a different size of said end wrench wherein said box shape removeably slides into said selectable angle end wrench.

* * * * *